US006945178B1

(12) United States Patent
Nye et al.

(10) Patent No.: US 6,945,178 B1
(45) Date of Patent: Sep. 20, 2005

(54) COLLAPSIBLE TABLE WITH BLOW MOLDED TABLE TOP

(75) Inventors: Stephen F. Nye, Syracuse, UT (US); Lynn C. Strong, Clearfield, UT (US)

(73) Assignee: Lifetimeproducts, Inc., Clearfield, UT (US)

( * ) Notice: Subject to any disclaimer, the term of this patent is extended or adjusted under 35 U.S.C. 154(b) by 113 days.

(21) Appl. No.: 10/190,275

(22) Filed: Jul. 5, 2002

Related U.S. Application Data

(63) Continuation of application No. 09/584,556, filed on May 31, 2000, now Pat. No. 6,443,521, which is a continuation-in-part of application No. 09/150,448, filed on Sep. 9, 1998, now Pat. No. 6,109,687.

(51) Int. Cl.[7] ..... A47B 3/00
(52) U.S. Cl. ..... 108/132; 108/129
(58) Field of Search ..... 108/35, 36, 125, 108/127, 129, 132

(56) References Cited

U.S. PATENT DOCUMENTS

| | | | | |
|---|---|---|---|---|
| RE18,207 | E | 9/1931 | Soltesz | |
| 2,109,869 | A | 3/1938 | Ross | |
| 2,279,122 | A | 4/1942 | Kovalchuk | |
| 2,452,169 | A | 10/1948 | Wells | |
| 2,474,450 | A * | 6/1949 | Woodruff | 108/132 X |
| 2,522,642 | A | 9/1950 | Schmidt | |
| 2,524,198 | A | 10/1950 | La Rue | |
| 2,568,622 | A | 9/1951 | Hagan | |
| 2,579,934 | A | 12/1951 | Krasney | |

(Continued)

FOREIGN PATENT DOCUMENTS

GB 665662 1/1952

(Continued)

OTHER PUBLICATIONS

Portable Table and Chair Set informational brochure, Brookstone®, Nashua, New Hampshire.

*Primary Examiner*—Anthony D. Barfield
(74) *Attorney, Agent, or Firm*—Workman Nydegger

(57) ABSTRACT

A collapsible table selectively positionable between an upright position above a surface and a collapsible position for storage. The table includes a table top having an envelope defining an interior cavity that is configured with an internal periphery sufficient for receiving one or more seating members therein when the table is positioned in the collapsed position. In operation, pedestals of the table may be pivoted between an extended position such that the pedestals support the table above a surface and a retracted position such that the pedestals are introduced within the interior cavity of the table and thereby substantially rest against the underside of the table top. The disposition of the seating members within the cavity of the table, and in relation to each other, further facilitates a means for securing the pedestals of the table in a collapsed position within the interior cavity of the table during storage. When the seating members are disposed within the interior cavity of the table, one or more retaining members may be used to selectively secure the seating members within the cavity of the table, thereby retaining the pedestals also within the cavity of the table when the table is positioned in the collapsed position for storage. Moreover, the seating members and table may be deployed independently from each other for use as an assembly or independently.

58 Claims, 19 Drawing Sheets

U.S. PATENT DOCUMENTS

| | | | | |
|---|---|---|---|---|
| 2,647,562 | A | | 8/1953 | Hoffar |
| 2,721,778 | A | | 10/1955 | Wilson |
| 2,748,837 | A | | 6/1956 | Beller |
| 2,752,987 | A | | 7/1956 | Smithers |
| 2,811,197 | A | | 10/1957 | Nimmo |
| 2,825,390 | A | | 3/1958 | Post |
| 3,028,197 | A | | 4/1962 | Wilson |
| 3,262,734 | A | | 7/1966 | Kuks |
| 3,273,936 | A | | 9/1966 | Deavers |
| 3,276,815 | A | | 10/1966 | Cardy |
| 3,574,393 | A | | 4/1971 | Hughes |
| 3,580,632 | A | | 5/1971 | Seymour |
| 3,672,719 | A | | 6/1972 | Haukedahl |
| 3,885,829 | A | | 5/1975 | Haeger |
| 3,994,527 | A | | 11/1976 | Nikitits et al. |
| D243,043 | S | | 1/1977 | Rogers |
| 4,047,754 | A | | 9/1977 | Cathey |
| 4,052,100 | A | | 10/1977 | Nikitits et al. |
| 4,064,812 | A | | 12/1977 | Commanda |
| 4,111,482 | A | | 9/1978 | Jones |
| 4,131,311 | A | | 12/1978 | Nikitits et al. |
| 4,143,601 | A | * | 3/1979 | Pike ..... 108/35 |
| 4,223,945 | A | | 9/1980 | Nikitits |
| 4,330,151 | A | | 5/1982 | Healey |
| 4,537,443 | A | | 8/1985 | Bray |
| 4,653,804 | A | | 3/1987 | Yoo et al. |
| 4,826,244 | A | | 5/1989 | Choi |
| 4,883,314 | A | | 11/1989 | Sakong |
| D327,779 | S | | 7/1992 | Jensen et al. |
| 5,314,231 | A | | 5/1994 | Otterbacher |
| D369,912 | S | | 5/1996 | Noll |
| 5,752,450 | A | | 5/1998 | Roesner |
| 6,032,585 | A | * | 3/2000 | Pinch ..... 108/36 |
| 6,058,853 | A | * | 5/2000 | Pinch ..... 108/129 |

FOREIGN PATENT DOCUMENTS

| | | |
|---|---|---|
| JP | 49-3062 | 10/1967 |
| JP | 48-9858 | 2/1973 |
| JP | 50-84303 | 12/1973 |
| JP | 3025644 | 11/1995 |

* cited by examiner

COLLAPSIBLE TABLE WITH BLOW MOLDED TABLE TOP

CROSS-REFERENCE TO RELATED APPLICATIONS

This application is a continuation of U.S. patent application Ser. No. 09/584,556, which was filed on May 31, 2000, now U.S. Pat. No. 6,443,521 entitled COLLAPSIBLE TABLE HAVING NESTED SEAT MEMBERS, which is a continuation-in-part of U.S. patent application Ser. No. 09/150,448, which was filed on Sep. 9, 1998, entitled NESTED, INDEPENDENTLY DEPLOYABLE BENCH AND TABLE APPARATUS AND METHOD and now U.S. Pat. No. 6,109,687, which are all hereby incorporated herein by reference in their entirities.

BACKGROUND OF THE INVENTION

1. The Field of the Invention

This invention relates to recreational furniture and, more particularly, to tables and benches for collapsed storage or for portable recreational use.

2. The Relevant Technology

Seating and tables have been the subject of numerous designs in furniture over a millennia. Furniture within homes, offices, and other places of meeting may be large, heavy, unwieldy, and may even be assembled in-place. However, another class of seating and tables exists.

Portable, or storable, tables and seating have been used for decades if not centuries. Stools, foldable assemblies, drop-down work spaces (tables, workbenches), C and so forth have been the subject of many designs. Banquet tables are often manufactured to be readily collapsible in order to facilitate rapid setup and takedown, storage, moving, and the like.

Similarly, recreational tables have been developed over many years. Recreational tables may be fixed in place. For example, concrete, wood, metal, and the like have been used as the frames, top surfaces, and so forth in tables. Durability has been a major factor in the construction of recreational tables for outdoor use. To a lesser extent, portability has become a factor in the design and construction of recreational tables.

Tables are frequently used in conjunction with chairs. Typically, benches are more efficient than chairs in the ability to seat numerous persons at a table. However, benches need stability. Moreover, benches tend to be quite heavy. An individual chair may be made in a size and weight to be readily transportable, foldable (collapsible), storable, and the like. By contrast, a bench becomes an article of a size similar to that of a table. Moreover, stability often dictates a size or weight that is not readily adaptable to be portable or storable.

Tables have become more portable, collapsible, storable, and the like in more recent years. However, most systems for picnic-type tables are not collapsible, readily storable, lightweight, or the like. Certain small systems have become prevalent in recent years. However, the size and utility of such collapsible systems has been marginal.

Storage is a matter of space, weight, and the availability of people to store and deploy equipment. Tables that are too large become difficult to store without the use of several people. Moreover, storage of tables, benches, chairs, etc., may demand substantial space.

What is needed is a readily storable, collapsible table system having seating integrated therein. For example, it would be advantageous to have a table with a bench integrated within the table. Preferably, the bench could remain within the envelope (projected area or space requirement) of the table when stored. Likewise, it would be advantageous to have a bench that may remain nested within a table during storage.

In certain situations, tables are used for serving, display, and the like. In such situations, seating is not required. Nevertheless, a table that is integrated with a bench or other seating typically deploys to space the seating somewhat away from the table itself. Accordingly, such a table tends to be heavy, bulky, and keeps viewers or passersby a distance away from the table. Accordingly, a table used for display or serving is not easily viewed with attached benches deployed at knee or shin level for a passerby, keeping such passersby away from the table top.

What is needed is a table that is collapsible but capable of containing its own seating. Moreover, it would be advantageous if the seating could be selectively deployed or stored within the envelope of the table without affecting the ability of the table to be used without deployment of the benches.

Also, it would be advantageous to have the benches separable from the table. For example, although benches and tables are often used in conjunction with one another, it may be advantageous to use benches independently from the table. Accordingly, it would be advantageous to be able to remove benches from the table for placement in another desirable location.

For example, around a campfire, or other recreational center of activity, a bench may be necessary or desirable. If benches must remain attached to a table in order for either one or both to be functional, then freedom to move the benches to a more desirable location is substantially limited. It would be advantageous in the art to have a table that may be deployed independently from its benches. Nested storage whether during transportation, or storage during the actual independent deployment of the table alone with the benches unneeded, would be a substantial advantage. Such a system in a size to be functionally equivalent to a banquet or picnic table, and of a weight suitable for portability would be very desirable.

BRIEF SUMMARY OF THE INVENTION

In view of the foregoing, it is a primary object of the present invention to provide a readily collapsible table and bench system that is completely nested within the envelope of the table. In one embodiment, a table may contain legs secured to pivot from an end of a table. For example, a pedestal may be formed having one or more legs extending from a frame of a table to a foot for placement on a surface. The pedestal or legs may extend from an end of a table toward the ground or surface for supporting the table.

Alternatively, the pedestal or legs may extend from the table, or an underside thereof, at a point spaced away from the end of the table. For example, banquet tables may advantageously have additional access for persons to sit at the end thereof if a table leg or pedestal is spaced away from the end of the table. Accordingly, in one embodiment, a table and bench system may be constructed to have a leg or pedestal extending away from the table toward a supporting surface, but secured at a distance spaced from an end of a table and designed to permit seating of a user at the end of the table.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include an upper surface formed of wood, plastic, or other material selected for weight, strength, and the like.

Moreover, the table may have reinforcement by way of a stringer or rail in order to improve the section modulus, stiffness and strength of the table. Benches may also have stringers or rails extending therealong. In an alternative embodiment, the section modulus of the table, or bench, or both may be improved by changing the thickness or width of the principal body thereof in order to obtain structural materials spaced as far as possible from the neutral axis (extend the outermost fiber). As a practical matter, the legs or pedestals of the table and bench, as well as the feet associated with those pedestals, may be formed of metal, and may be designed to have a tubular cross-section for improving strength minimizing weight.

A system of latches, detents, and the like may be formed along an underside of the table in order to latch the benches into place, secure the legs of the benches and the legs of the table to remain secured against the underside of the table, and so forth.

The table and benches may be formed of wood, metal, such as extrusions or expanded metal, whether steel or aluminum, and the like. Moreover, the tables, benches, or both may be fabricated of certain plastics, for example, the table top and the bench tops may be formed of blow-molded or vacuum formed polymeric resins. Alternatively, large expanses of sophisticated cross-section may be formed in a tumble-molding operation. The section modulus of the table may be improved by blow molding or tumble molding.

Also, in certain embodiments, the tables, bench, or both may be filled with expanded polymeric materials, such as expanded polystyrene or expanded urethane in order to against bucking failure of hollow sections. In other embodiments, the wall thickness of a plastic table or plastic bench may be substantially increased to provide sufficient stiffness and strength without interior stiffeners such as expanded plastics or polymers or with fewer stiffeners.

In an alternate preferred embodiment of the present invention, the table includes a table top having a cavity that is configured with an internal periphery sufficient for receiving one or more seat members therein when the table is positioned in a collapsed position. In operation, the support pedestals of the table may be pivoted from an extended position into a collapsed position, such that the pedestals are introduced within the internal periphery of the cavity and substantially rest against the underside of the table top. In one presently preferred embodiment, the seat members are preferably introduced within the internal periphery of the cavity of the table top in such a manner so as to secure the support pedestals of the table in the collapsed position during storage of the table.

In particular, the collapsible table is selectively positionable between a first upright position above a surface and a second collapsible position for storage. The support pedestals of the table and one or more seat members may be selectively retained within an internal periphery of a cavity formed in the table top. Specifically, the disposition of the seat members within the cavity and in relation to each other provides a means for also securing the support pedestals of the table in the collapsed position within the cavity for storage. The present invention also contemplates a collapsible table which does not include a cavity that is configured to receive the support pedestals and the seat members, but rather comprises sufficient hardware to securely fasten the support pedestals of the table and the corresponding seat members into selective engagement with the underside of the table top.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 12 is a perspective view of one alternative embodiment for a bracket and axle for pivoting a leg of a pedestal for a table, bench, or the like;

FIGS. 14A–14E illustrate selected, alternative embodiments for mechanisms to lock legs, pedestals, feet, and the like in place for benches, tables, and the like;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 19 is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
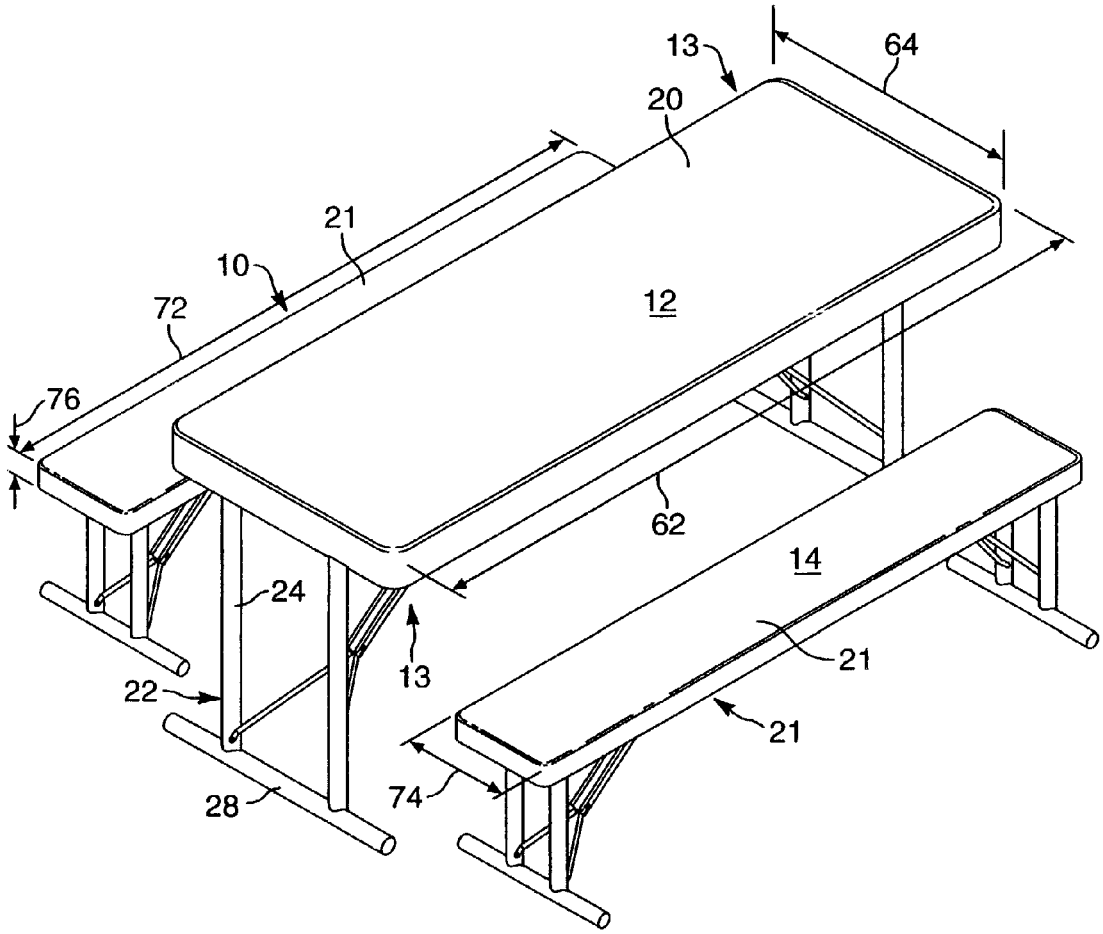
FIG. 1 is a perspective view of a table and bench system in accordance with the invention.

Referring to FIG. 1, and generally to FIGS. 1–14, an apparatus 10 may be formed to include a table 12 and a bench 14. Multiple benches 14 may be included in one presently preferred embodiment. The table 12 may be constructed to have a frame 16, and the bench 14 may have a frame 18.

In one embodiment, the principal frame 16, 18 of the table 12 and the bench 14, respectively, may be formed of metal, such as an extrusion. However, the entire surface 20 of the table, the surface 21 of the bench, and the like, may be formed as a single piece to include the respective frames 16, 18 in a metal stamping. In one presently preferred embodiment, the top surface 20, 21 of the table 12 and the bench 14, respectively, may be formed of expanded metal. In another alternative embodiment, a reinforced, crimped, solid sheet may be used, stiffened with proper changes in section modulus by corrugation, and the like.

In certain embodiments, the top surface 20, 21 of the table 12 and the bench 14, respectively, may be formed of wood, with a metal rail as the frame 16, 18, respectively. In one presently preferred embodiment, the entire frame 16 of the table forming, tumble-molding, or the like. Similarly, the bench 14, and more particularly the frame 18 and top surface 21, may be formed by any of the same or similar methods. As will be appreciated, the table 12 and the bench 14 need not be manufactured by the same process.

However, as a practical matter, lightweight plastic structures may be formed to render the table 12 and the benches 14 readily transportable. Inasmuch as an easy deployment is desirable, and a simple collapse and storage is desirable, for any table 12 and bench 14, plastic resins are to be preferred in certain embodiments. Moreover, minimizing the number of persons required and the strength required of a person in order to deploy and collapse a table 12, one or more benches 14, or both, is very desirable. Therefore, hollow structures may be preferred, and may be more readily available by such forming methods as stamping of metals, vacuum forming of resin sheets, blow-molding of hollow structures, and tumble-molding of complex, hollow structures.

Figure 4:
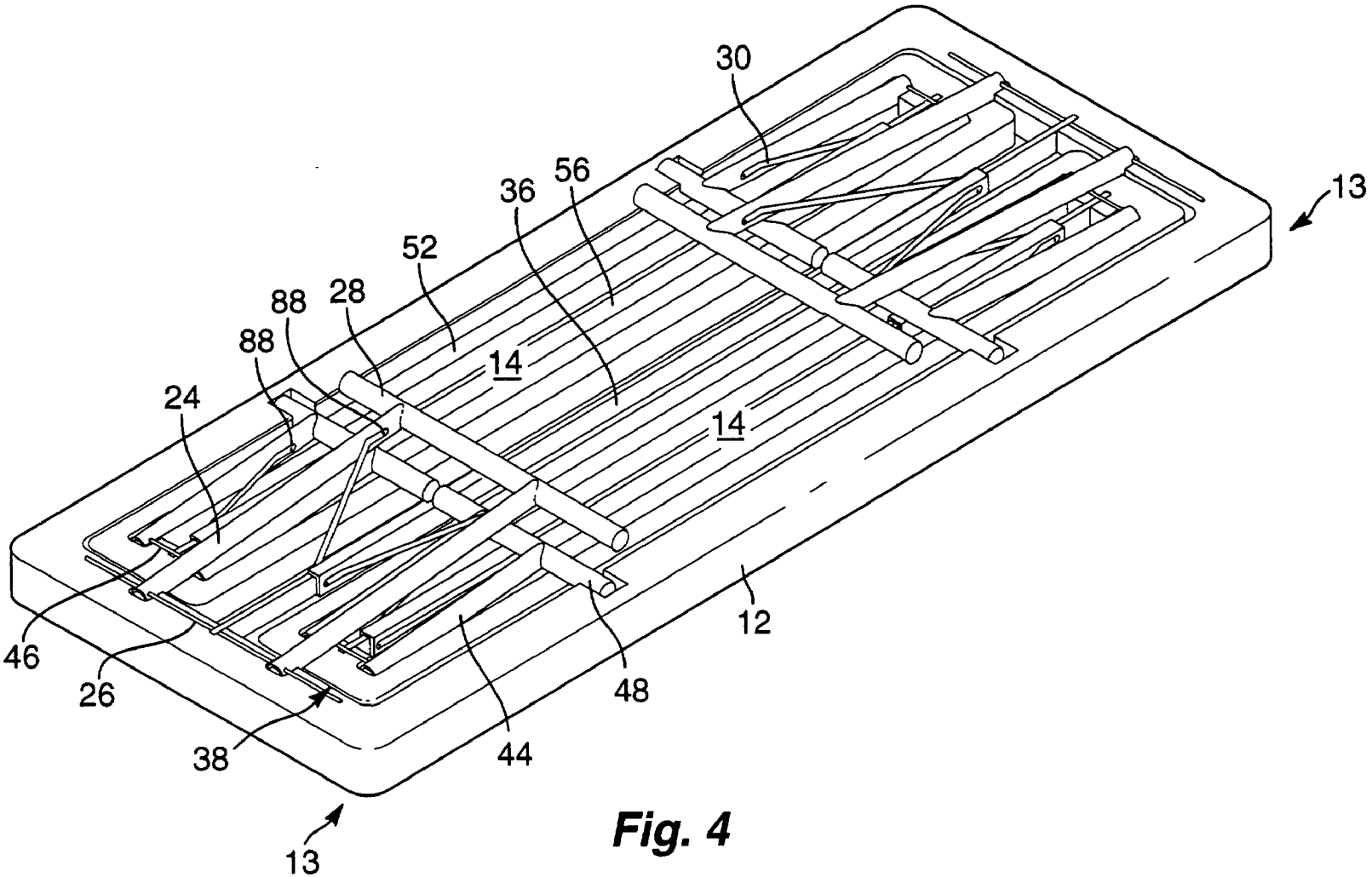
FIG. 4 is a perspective view of the apparatus of FIGS. 2–3 in a collapsed and nested configuration.

In one presently preferred embodiment, a pedestal 22 may support a table 12. A pedestal 22 attached at each end of the table, or close by, may be formed having legs 24 or a single leg 24. To maximize strength and stability, while minimizing weight, the legs 24 may be spaced apart and two or more may be used. The leg 24 may be pivoted at an axle 26 securing the legs 24 (e.g., the pedestal 22) to the table 12, as best shown in FIG. 4. A foot 28 may be provided to support the pedestal 22 and table 12 on a supporting surface, such as a portion of lawn, patio, ground surface, floor, or the like.

As a practical matter, a brace 30 or strut 30 may be provided to selectively collapse and deploy for strengthening and stiffening the structural assembly comprising the table 12 and pedestal 22. The brace 30 may extend from the foot 28 to the table 12, or from some other location along a leg 24 and the table 12. In one presently preferred embodiment, the brace 30 may be formed in multiple pieces 32, 34 associated with the table 12, and leg 24 or foot 28, respectively. The brace 30 may be designed to slide along a rail 36 or stringer 36 extending along a central portion of the table 12 and generally extending from end to end. However, in an alternative embodiment, the brace 30 may simply break (pivot) at some intermediate point between the table 12 and the pedestal 22 upon release of a lock, or upon pushing a break-over-center-type pivot from a stable, deployed position, to an unstable, collapsing position.

The frame 16, 18 need not be formed completely flat or smooth. For example, a rim 38 may be formed to extend around the entire perimeter of the table 12, as shown in FIG. 4. The rim 38 may tend to stiffen and strengthen the overall table 12 by providing increased section modulus. Moreover, the rim 38 may also provide definition of an envelope to completely cover the nested benches 14 when collapsed and stored. In addition, the rim 38 may provide definition of the bottom of a table 12 in order to prevent persons from bumping into or against a bench 14 stored within the envelope of a table 12.

The benches 14 may include pedestals 42 having one or more legs 44. The pedestals 42 may extend downwardly from each opposing end of the bench, or may be placed at a location spaced from the end of the bench 14. The legs 44 may be secured to respective axles 46 extending therethrough and secured to the frame 18 of the bench. Nevertheless, various types of fastening arrangements may be provided, commensurate with the sizes of benches 14, legs 44, pedestals 42, and the relationships thereof with the dimensions of the table 12.

In one embodiment, the legs 44 may be secured to axles 46 forming pivots 46 near the opposing ends of the benches 14. The legs 44 may extend downward to be secured (e.g., welded, bolted, fastened, etc.) to a foot 48. The foot 48 may extend along a supporting surface to provide stability. Moreover, "floatation" may be provided in that a foot 48 may distribute stress on a supporting surface, preventing sinking of a leg 44 into the ground, for example. Also, a foot 48, particularly if formed of a right, circular, cylindrical tubing, may facilitate moving a bench 14 on a supporting surface. Similarly, a foot 28 of a pedestal 22 corresponding to a table 12 may be similarly relied upon to provide easy sliding of the foot 28 on a surface supporting the table 12. Rectangular tubing may be used to similar advantage in forming any or all portions of the pedestals 22, 42.

A brace 50 may extend from a bench 14 to a pedestal 42. The brace 50 may provide stiffening and support, similar to that provided by the brace 30 to the table 12. The brace 50 may be formed in multiple pieces 32, 34 to be collapsible. Alternatively, the brace 50 may be formed to latch and release selectively along a rail 56 or stringer 56 extending along the length of the bench 14. That is, in certain embodiments of the present invention, lightweight may dictate minimizing dimensions of materials in the bench surface 21 and table surface 20. Accordingly, one or more stringers 36, 56 may be deployed to extend along the lengths of the table 12 and the benches 14, respectively. In one embodiment, such a rail 36, 56 may be formed of a worked metal piece. Alternatively, a reinforced polymeric composite may be used. In one embodiment, a deep section of the principal material from which the table 12 or the bench 14 is formed may be extended to make a rail 36, 56 or stringer 36, 56. Thus, the brace 30, 50 may be fabricated to collapse to a stored, folded condition, and to extend and lock in a deployed triangulating position stabilizing the respective support pedestal 22, 42. Nevertheless, a sliding arrangement may also be used, to include a key, notch, latch, or other binding mechanism to fix an end of the brace 30, 50 against the rail 36, 56, or against the respective table 12 or the bench 14, as appropriate.

The rim 38 may extend about the perimeter of the table 12 in order add section modulus, to extend the outer most fiber, in engineering terms, to a maximum distance away from a neutral axis (e.g., center with respect to the load). Similarly, the section modulus of the upper surface 20, 21 of the table 12 and the bench 14, respectively, may be increased by adding a rim 60 extending near a top of the surface 20, 21. As a practical matter, a modest boss 60 or rim 60 may be provided without discomfiting a user seated at a table.

Figure 2:
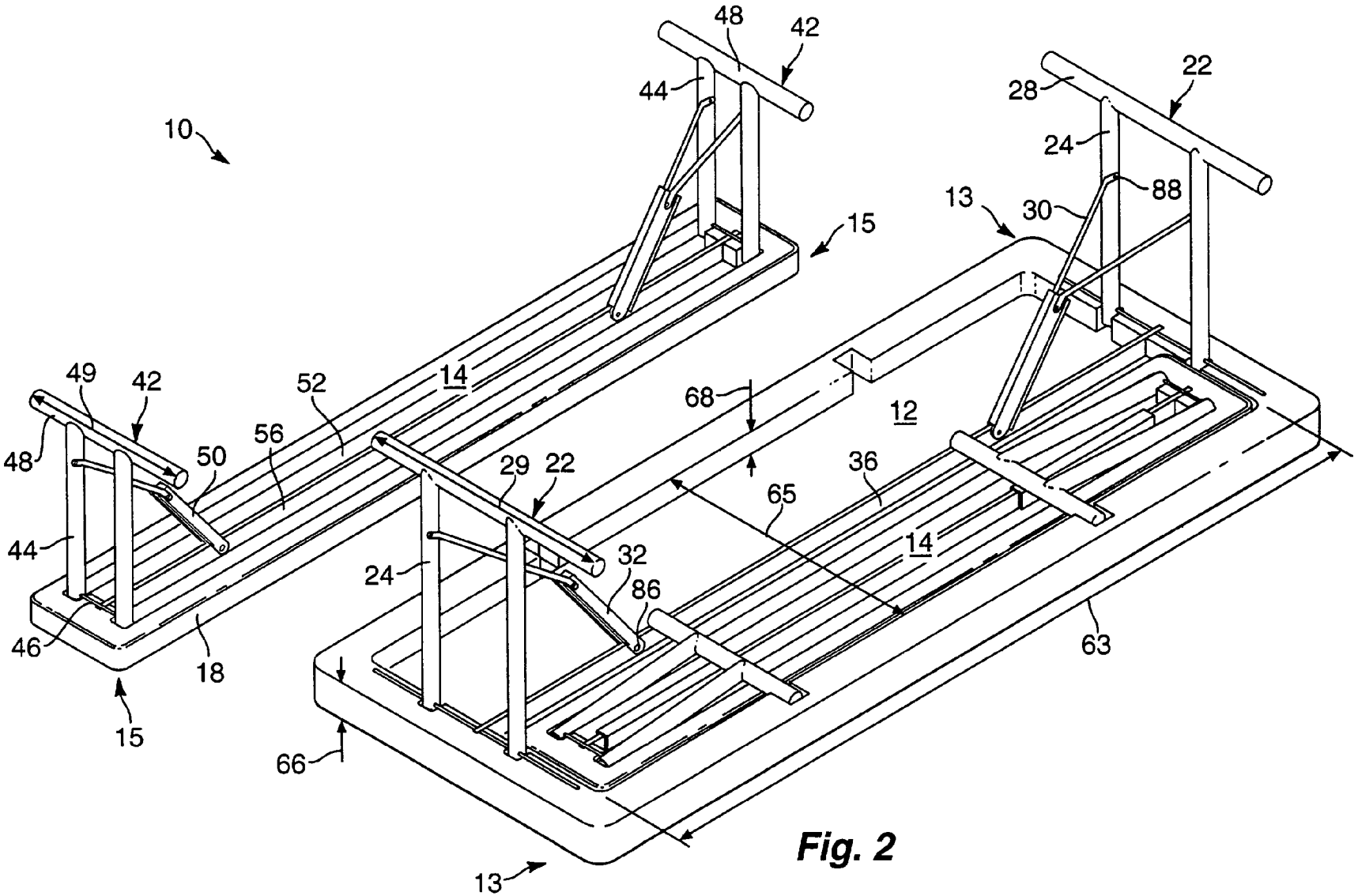
FIG. 2 is a perspective view of the underside of a table and bench system in one embodiment in accordance with the invention.
Figure 3:
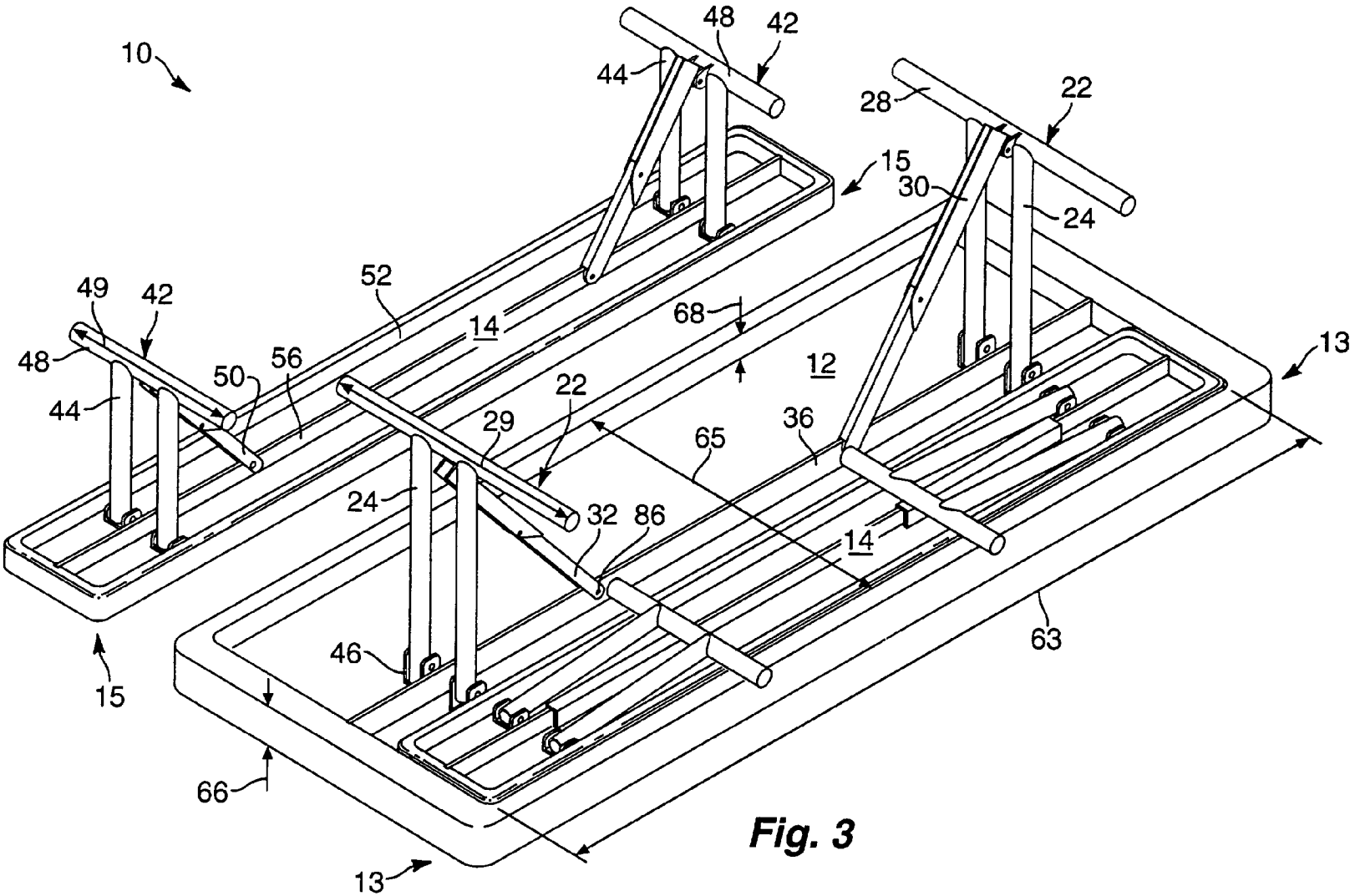
FIG. 3 is a perspective view of the apparatus of FIG. 2, partially collapsed and nested.

A length 62 of an outer envelope of a table 12 may be selected to accommodate users. Certain ergonomic factors may be used to design the length 62 in order to accommodate a specific number of users. For example, a table may be designed to provide a specific distance or space for each user, and a specific number of users. Such factors may dictate eighteen (18) inches, or twenty-two (22) inches, depending on some preselected comfort factor, as a width suitable for each average person. Accordingly, the length 62 may be a multiple of a width of a theoretical single individual. As best shown in FIGS. 2 and 3, the length 63 inside the table 12 may be selected to fit a bench 14 therein. Referring to FIG. 1, a width 64 outside of a table 12 may be selected to meet ergonomic criteria, similar to those selected for the length. For example, it is often desired that a user may be seated at one end of the table 12. Accordingly, the width 64 may be selected to accommodate a user at an end of a table 12, without discomfiting users on each side of the table and positioned near the end.

Referring back to FIG. 2, a width 65 inside the table 12 may be selected to accommodate any hardware structures that may be required. For example, a stringer 36, whether a separate metal structure, composite, polymeric structure, wood, or the like, or an increase in the section of the table 12 itself, may be accommodated within the width 65. Similarly, the size of the benches 14 may be accommodated within the width 65 for complete nesting of the benches 14 within the envelope of the table 12.

The thickness 66 on the outside of the envelope of the table 12 may be selected to support the table by providing section modulus or stiffness. Also, the thickness 66 may be designed to accommodate the size of a user seated on a bench 14, along with the proper altitude for positioning the top surface 20 of the table 12.

A thickness 68, interior to the table 12 may be selected to contain a bench 14, the pedestal 42 thereof, and the pedestal 22 of the table 12, itself. As a practical matter, suitable legs 24, 44 may be fabricated from steel tubing having an outer diameter of approximately 1 inch. In certain embodiments, the legs 24, 44 may be formed along with the feet 28, 48, respectively, to have a diameter of approximately 2 inches. However, for storage, compactness, and the like, additional wall thickness may be provided for each of the pedestals 22, 42 in order to sustain smaller outer diameters. Thus, the height 68 of the interior cavity 69 may be selected to secure any of the hardware of the table 12 and the bench 14 desired during storage, deployment, or both.

Figure 7:
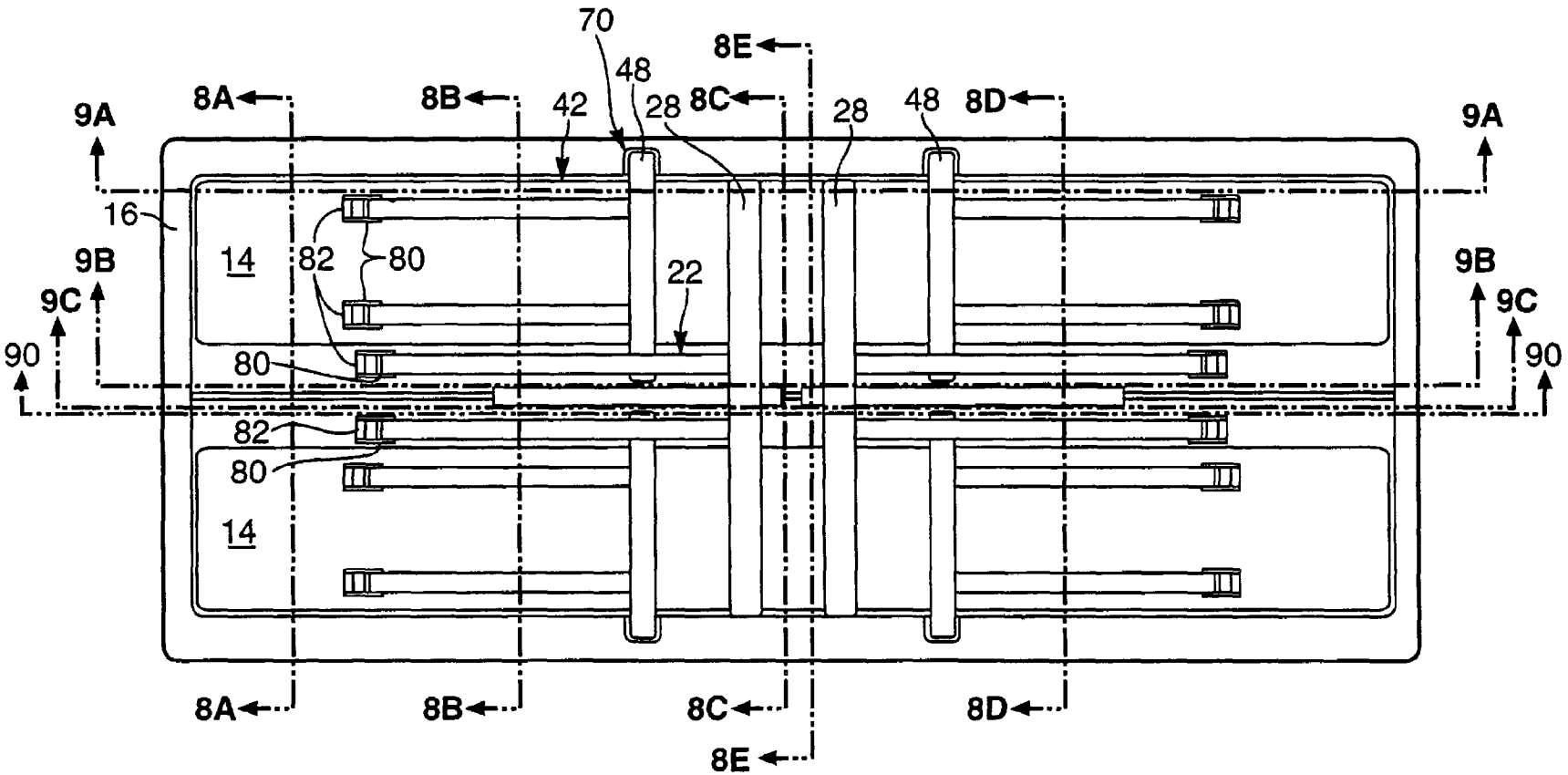
FIG. 7 is a bottom plan view of the apparatus of FIG. 6 illustrating a nested and collapsed arrangement.

As illustrated in FIG. 7, in certain embodiments, a relief 70 may be formed in the table 12 order to accommodate the foot 48 of a bench 14, or even the foot 28 of the table 12. A relief 70 is not required in every embodiment. Nevertheless, stability of the benches 14 and the table 12 may militate in favor of providing a maximum length 49 of a foot 48, or length 29 of a foot 28 of a table 12. A user seated on a bench 14 may push with feet, or may position oneself in a location rendering the bench 14 unstable. Thus, in one presently preferred embodiment, the length 29 of a foot 28 may be substantially greater than the width 74 of a bench 14. Thus, no weight applied to a top surface 21 of a bench 14 could provide a moment, couple, torque outside the foot 28. Thus, additional stability may be provided by having a length 49 greater than the width 74.

The thickness 76 of each bench 14 may be selected to provide the proper strength and stiffness for comfortably supporting the number of users designed into the lengths 72 of the bench 14. As a practical matter, the thickness 76 may be influenced substantially by the dimension and material selected for a stringer 56, if present. Thus, a rail 56 or stringer 56 may stiffen the bench 14, thereby minimizing the thickness 76 required of the bench 14. The length 72 and height 73 of the bench 14 may be selected to comfortably seat users. The length 72 should also be selected to fit within the length 63 inside the envelope of the table 12.

Attachment of the pedestals 42, 22 to the bench 14 and the table 12, respectively, may be made by a variety of methods. In one embodiment, a bracket 80 may be formed into or secured to the table 12. An axle 82 may be formed to secure a leg 24 to the bracket 80. The bracket 80 may be formed as part of the frame 16 of the table 12, or may be an isolated part, such as a metal bracket 80 secured by a fastener to the table 12. In one embodiment, an axle 82 may secure a leg 24 into a bracket 80 with a nut 84 securing the axle 82 into the bracket 80. A pivot 86 may be provided on a rail 36 or stringer 36. Similarly, one or more pivots 88 may be provided on a leg 24 or pedestal 22, including the foot 28. The brace 30 may be shorter if connected only between a leg 24 and the table 12. The brace 30 may be substantially longer, but provide increased leverage if connected from the foot 28 to the table 12. As discussed, the pivot 86 positioned at the table 12 or on the rail 36 may be made to slide along the rail 36, or may be fixed at a single location. In one embodiment, a pivot 88 may be secured at one or more points to a leg 24 or legs 24. Meanwhile, the brace 30 may break at a pivot 90 in order to collapse and fold against a table 12 or over a rail 36.

In one embodiment, ears 92 may be formed to secure the brace 30 to the pedestal 22, the rail 36, or the table 12. A clevis-type arrangement may be desirable in order to provide suitable clearances. Alternatively, close clearances and tolerances may provide riveted pivots 86, 88, 90 dispensing with any separate ears 92, 94. For example, method bending techniques may provide a brace 30 formed entirely by stamping steel sheets into an appropriate cross-section for stiffness, strength, and the like. Ears, attachment points, apertures, and the like, may be provided in similar stamping operations by punch presses, bending brakes, and the like.

Referring to FIGS. 2–5, and generally to FIGS. 1–14, a table 12 may be formed to nest benches 14 within the envelope thereof. For example, in FIG. 2, the underside of a table 12 and corresponding benches 14 are illustrated.

The benches 14 are designed to nest within one or more cavities 69 formed within the envelope of the table 12. In FIG. 2, the view of the underside of the table 12 and the benches 14 illustrates the collapsible pedestals 42 of one of the benches. In FIG. 3, one of the benches 14 is positioned within the cavity 69 of the table 12. As shown, one of the benches 14 has been collapsed, while the other bench has its pedestals 42 extending away therefrom.

Referring to FIG. 4, the pedestals 42 of both benches 14 are collapsed beneath (depending upon one's perspective) the collapsed pedestals 22 of the table 12. The entire pedestals 22, 42 of the table 12 and the benches 14 may be fit within the envelope of the table 12. In one alternative embodiment, the benches 14 may fit within the envelope of the table 12, but the pedestals 22 of the table 12 need not. That is, having benches 14 nesting within a table 12 during use of the table 12 without the benches deployed, may require that the benches 14 not extend as obstructions beneath the table 12. However, since the table pedestals 22 are deployed anytime the table 12 is in use, not every embodiment of the table 12 need require the pedestals 22 to fit within the envelope of the table. As a practical matter, one may think of the envelope of a structure as the shape that would be taken by an elastic band completely encircling the object in question. Thus, a table top 20, may define a straight line portion of an envelope. The size and shape of the frame 16 may define another portion of the envelope of a table 12. If the pedestals 22, 42 nest completely within a table, then a straight line extending across the frame 16 of the table 12 may define another edge of the envelope of the table 12.

Figure 5:
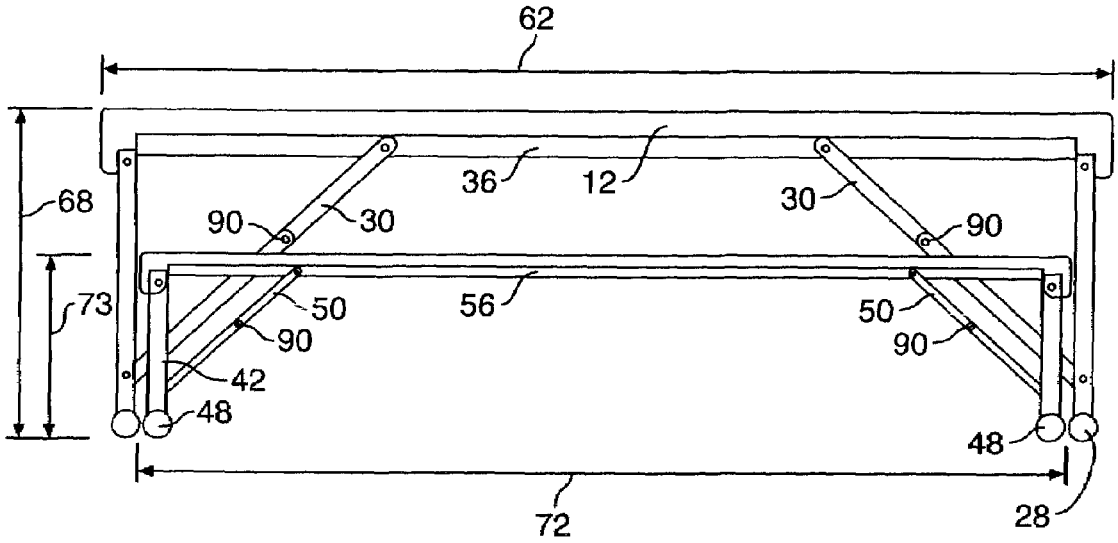
FIG. 5 is a side elevation view of the apparatus of FIGS. 2–4 illustrating one embodiment of positioning and bracing of legs and supporting surfaces.

Referring to FIG. 5, a table 12 and bench 14 are illustrated in a side elevation view. The collapsible struts 30, 50 or braces 30, 50 are illustrated with corresponding pivots 90. The brace 30, 50 may be made to pin or slide and latch along the respective rails 36, 56, or may be made to brake and lock selectively in order to triangulate the respective pedestals 22, 42.

The length 72 of the bench 14 is designed to fit within the cavity 69 on the underside of the table 12. The height 68 of the table 12 may be on the order of thirty (30) to thirty-four (34) inches high in one presently preferred embodiment. The height 73 of the bench 14 may be approximately twenty (20) inches. The overall length 62 of the table 12 may be six (6) feet or eight (8) feet, in various, alternative embodiments. In one embodiment, the table length 62 may be four (4) feet. The width 74 of each bench 14 may be twelve (12) inches or more. If the overall width 64 of the table 12 is approximately thirty (30) inches, then the overall width or length 29 of each of the feet 28 of the benches 14 may be selected to be approximately half the width 64, or actually half the interior width 65 of the table 12. If the relief 70 is provided within the frame 16 of the table 12 in order to receive the feet 48 of the benches 14, then the overall length 49 of the feet 48 of the benches 14, may be, nominally, half the full outside width 64 of the table 12, approximately fifteen (15) inches. Thus, in one embodiment, a foot 48 may have a length 49 of fifteen (15) inches, with a width 74 of the seat 14 or bench 14 of twelve (12) inches, providing additional stability. Extensions may be provided for the feet 48, for extending outwardly in order to preclude tipping of the benches 14. Alternatively, the feet 48 may be offset somewhat, rather than centered, in order to provide more of a foot 48 extending behind a user.

Figure 6:
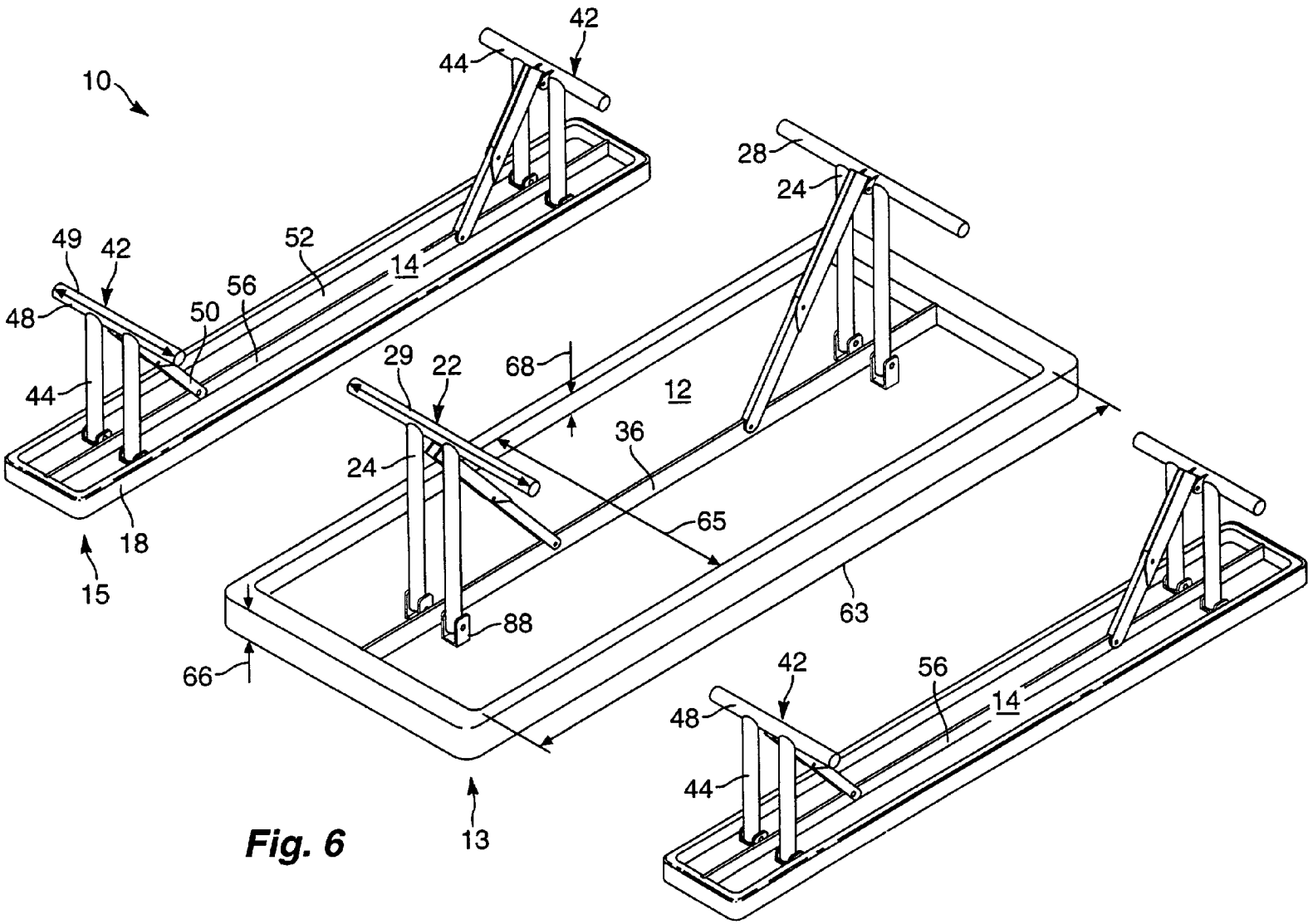
FIG. 6 is a perspective view of an underside of an alternative embodiment of an apparatus in accordance with the invention, having the pedestals spaced from the ends of the benches and tables.

Referring to FIG. 6, and generally to FIGS. 6–9, while continuing to refer in general to FIGS. 1–14, an alternative embodiment of a table 12 and benches 14 may position the pedestals 22, 42 away from the end or ends 13 of the table 12. In one embodiment, brackets 80 may secure axles 82 throughout legs 24. Thus, the braces 30 may more easily be extended to contact one another near the center of the table 12. Nevertheless, with a rail 36 stiffening a table 12, the braces 30 may connect directly in a pivotable fashion to the rail 36 as discussed above. The embodiment of the table of FIG. 6 may be collapsed with each of the benches 14 nested within the cavities 69 of the table 12, as illustrated in FIG. 7.

Referring to FIG. 7, a bottom plan view of the table 12 and benches 14 of FIG. 6 is illustrated in a collapsed and stored position. In one particular embodiment, each of the pedestals 22, 42 may pivot about axles 82 in a bracket 80 (see FIG. 3 and FIG. 12) to pivot downward to the table 12. The pedestals 42 of the benches 14 may collapse first. A relief 70 may be provided for receiving the feet 48 into the frame 16 of the table 12. In one embodiment, the pedestals 22 of the table 12 may be designed to overlap the feet 48 of the pedestals 42 of the benches 14. Thus, securement of the feet 28 and pedestals 22 of the table 12 may automatically secure the feet 48 and pedestals 42 of the benches 14.

However, in certain alternative embodiments, latches, clips, keys, detents, and the like may be provided for securing the benches 14 and pedestals 42 thereof independently from the pedestals 22 of the table 12. Thus, the benches 14 may remain secured and nested within the table 12, even while the table 12 is deployed for use.

Referring to FIGS. 8–9, while still referring generally to FIGS. 6–7, and more generally to FIGS. 1–14, various end, elevation, cross-sectional views are illustrated along with side, elevation, cross-sectional views of various embodiments of an apparatus 10 in accordance with the invention. Referring to FIG. 8*a*, a bench 14 may be nested within a cavity 69 of a table 12. The benches 14 may fill the entire cavity 69, or may fill less than the cavity 69. A rail 36 may be an independent structure or may be a mirror extension of the table 12.

Figure 8A:
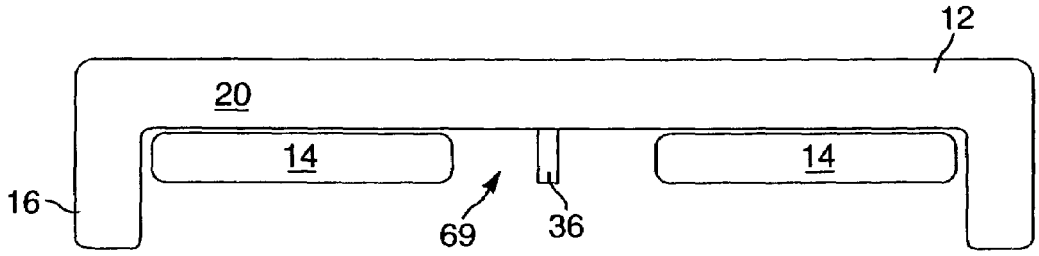
FIGS. 8A–8E illustrate end, elevation, cross-sectional views of an alternative embodiment of an apparatus in accordance with the invention and more particularly adaptable to the apparatus of FIG. 7.
Figure 8B:
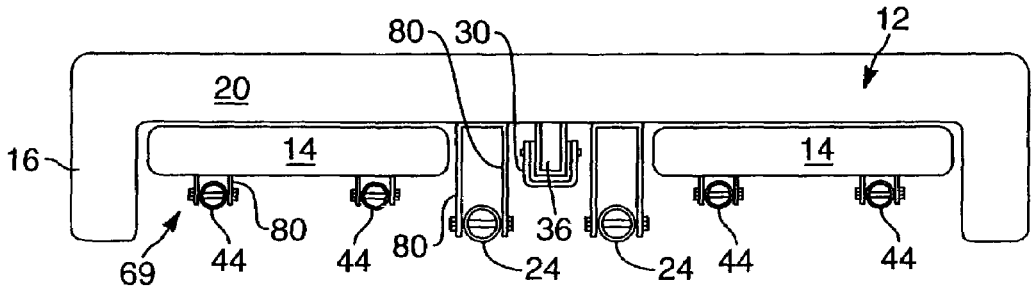

Referring to FIG. 8B, the brackets 80 may be secured to the table surface 20, referred to generally here as the entire table top 20, rather than simply the actual top surface. The table top 20 may be stiffened by the rail 36, and the brackets 80 may extend a distance away from the table top 20 and bench top 21 sufficient to permit the respective pedestals 22, 42 or legs 24, 44 to pivot appropriately.

Figure 8D:
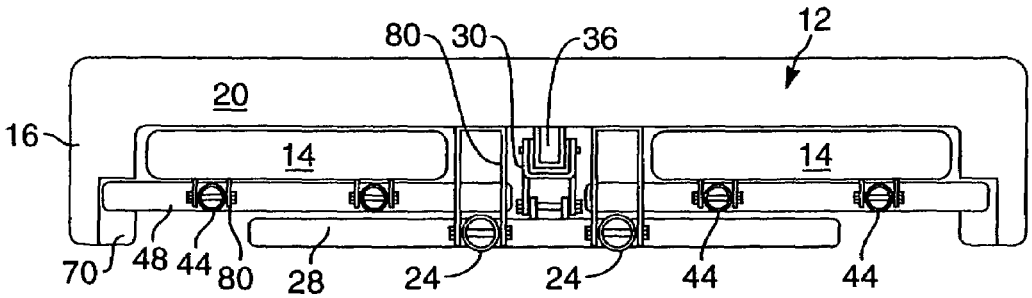

Referring to FIG. 8D, the feet 28 of the table 12 may extend a distance suitable for supporting the table top 20 stably. The overall length 29 of the foot 28 of the pedestal 22 may extend the entire inner width 65 or outer width 64 of the table top 20 of the table 12. A relief 70 may be provided for receiving the feet 48 of the benches 14, the feet 28 of the table 12, or both. The relief 70 may extend to the outermost width 64 of the table top 20. Nevertheless, as illustrated in FIG. 8-D, and 8-E, the relief 70 may leave the frame 16 intact for appearances, additional structural strength, or other functional purposes.

Referring to FIG. 5C, one alternative embodiment of an arrangement of the benches 14 nested completely within the envelope of the table 12, along with the entire pedestals 48 of the benches 14 and the pedestals 28 of the table 12 are illustrated. Referring to FIG. 8E, the shape of the table top 20 may be formed by injection molding, vacuum forming, tumble molding, or reaction injection molding, or the like in order to provide a more complex cross-section. Accordingly, the bench tops 21 of the benches 14 may be snugly fitted to the interior cavity 69 of the table top 20. Alternatively, the overall width 74 of each bench top 21 may consume approximately half of the overall interior width 65 of the cavity 69 of the table top 20.

Figure 8C:
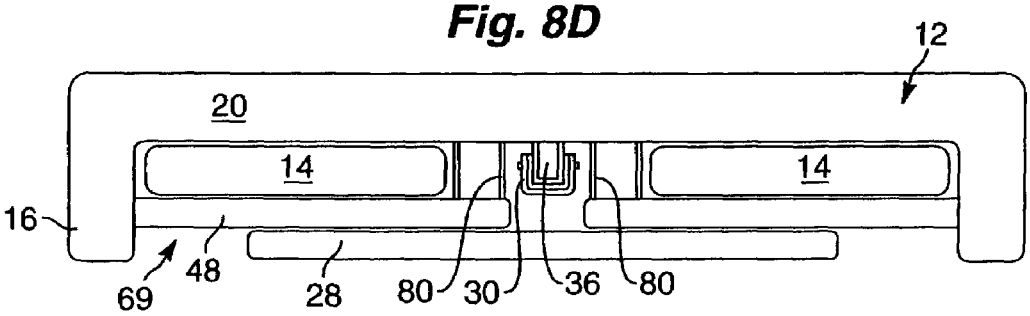
Figure 8E:
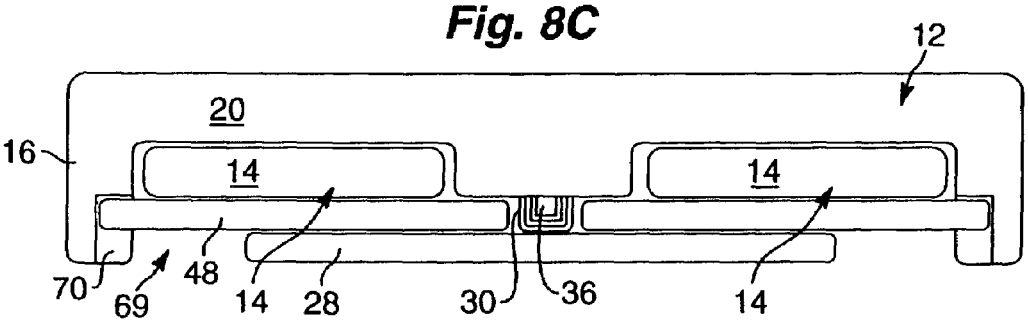
Figure 9A:
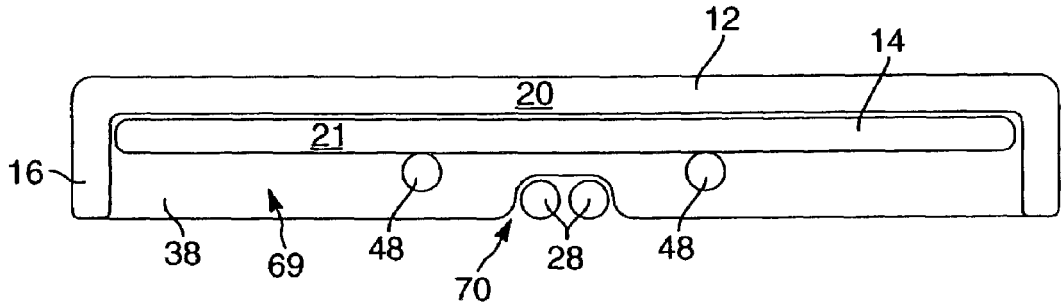
FIG. 9 is a side elevation cross-sectional view of the apparatus of FIG. 7.
Figure 9B:
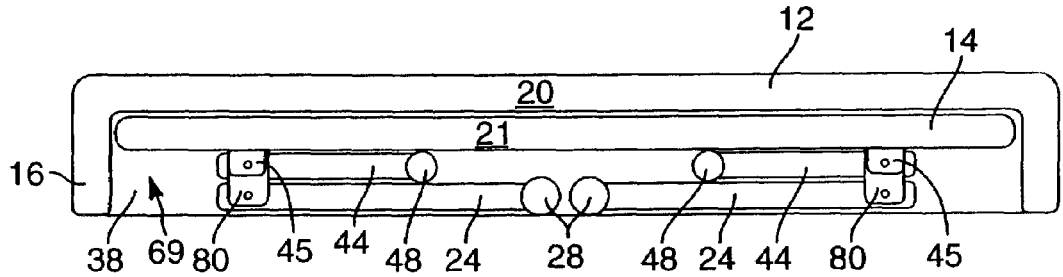
Figure 9C:
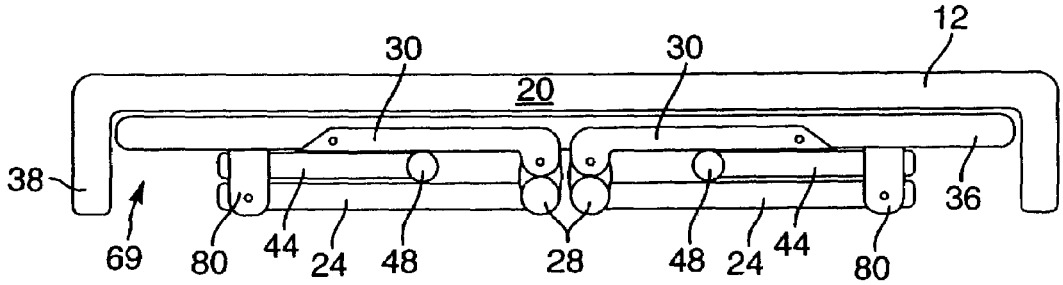

Referring to FIGS. 9A–9D, while continuing to refer to FIGS. 7–8, as well as referring generally to FIGS. 1–14, a side, elevation, cross-sectional view of certain alternative embodiments of an apparatus 10 in accordance with the invention are illustrated. The table top 20 and the frame 16 may be formed to completely receive the pedestals 28, 48 of the table 12 and benches 14. The entire bench tops 21 along with their respective pedestals 48 may fit within the cavity 69 of the table 12 or table top 20. A relief 70 may be provided for the feet 28 of the pedestals 22, or for the feet 48 of the pedestals 42 of the benches 14. Referring to FIG. 9C, the braces 30 may be seen in one embodiment to be formed to wrap around the rail 36 or stringer 36 extending along the length 62 of the table 12. The brackets 80 may be formed in any suitable fashion to fit the geometry of the respective pedestals 24, 44, and the shape of the table top 20 and bench tops 20 desired.

Figure 9D:
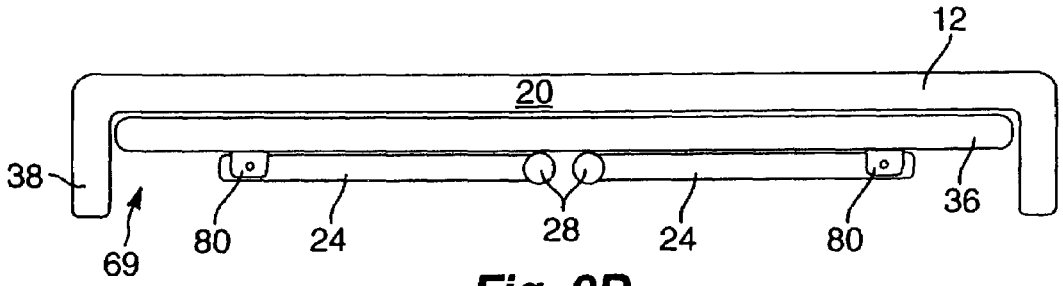

Referring to FIG. 9D, an alternative embodiment of the rail 36 may simply be an extended depth of the cross-section of the table top 20. Thus, the rail 36 merely becomes a particularly thick section of the table top 20. The size of the brackets 80 may be reduced since extension away from the table top 20 need not be so extensive.

Figure 10A:
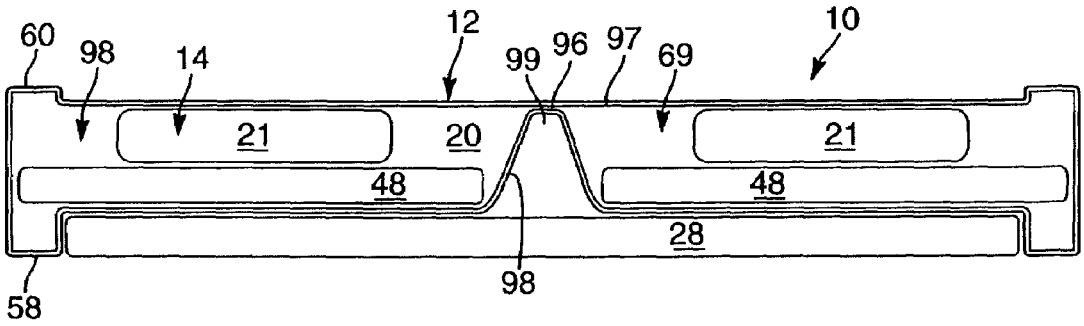
FIG. 10A is a an end, elevation, cross-sectional view of an alternative embodiment of a table and bench system in accordance with the invention, relying on a hollow table top that may be blow-molded or tumble-molded.
Figure 10B:
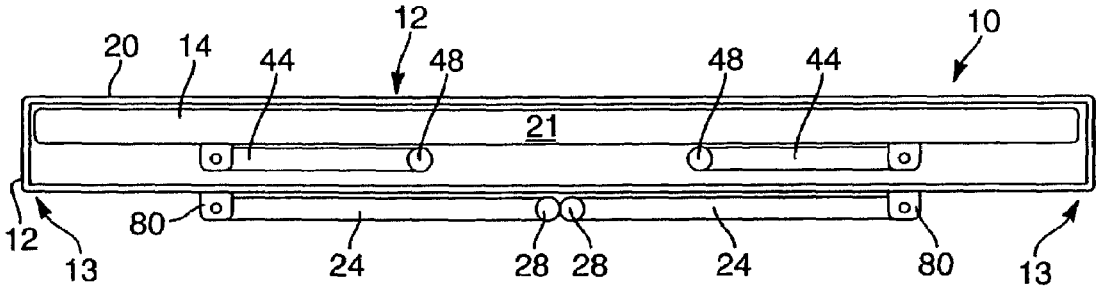
FIG. 10B is a side, elevation, cross-sectional view of an alternative embodiment of an apparatus in accordance with the invention, consistent with FIG. 10A, and FIG. 10C.
Figure 10C:
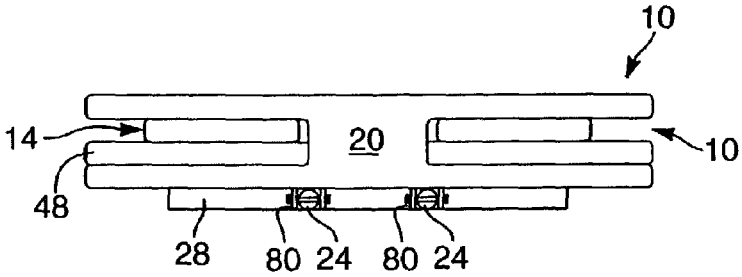
FIG. 10C is an end, elevation, cross-sectional view of one alternative embodiment of a table and bench system in which the benches are nested within a side cavity of a table.

Referring to FIGS. 10A–10C, certain alternative embodiments for an apparatus 10 in accordance with the invention are illustrated. In the illustration of FIG. 10A, an alternative embodiment of an apparatus 10 is illustrated in an end, elevation, cross-sectional view. In this embodiment, a table top 20 may be formed to be hollow. Such a formation may be completed successfully using blow-molding, vacuum forming, tumble molding, and the like. As a practical matter, the table top 20 may be formed to provide a hollow for receiving the benches 14. The hollow cavity 69 or cavities 69 may be formed in the table top 20 for receiving the benches 14. In one embodiment, a weld 96 may secure a top surface 97 to a riser 98 for stiffening the table top 20. A cavity 99 may result which may then support and receive, for example the brace 30. Moreover, the riser 98 may act as the rail 36 adding stiffness by increasing the section modulus of the table top 20. The dimensions of the cavity 99 may be selected for structural and spatial considerations in strengthening the table top 20 and in receiving the benches 14.

In the embodiment of FIG. 10A, the benches 14 may slide directly into an end 13 of a table top 20. End caps may optionally be provided for hiding the benches 14 and stiffening the tabletop 20. A rim 58 may extend downwardly, while a rim 60 may provide a boss 60 or rise 60 for stiffening the overall top surface 12. The top surface 12 and the pedestal 98 may actually be formed in separate operations, such as by vacuum forming to be sealed, welded, bonded, or otherwise fastened together. Alternatively, the entire structure of the table top 20 may be formed by blow molding or tumble-molding to form a strong, stiff, consistent structure having cavities adapted to receiving the benches 14.

Referring to FIGS. 10B–10C, a side, elevation, sectioned view is illustrated with an end, elevation, cross-sectional view of a table top 20 and benches 14. In one embodiment, the pedestals 24 corresponding to the table 12 may be secured outside the envelope of the table top 20. Meanwhile, the benches 14 may be stored in slots formed in the sides of the table top 20. As a practical matter, the apparatus 10 of FIGS. 10B– 10C may be provided with caps for sealing the cavities 69 for aesthetic purposes. An advantage of the apparatus 10 of FIGS. 10B–10C is the improved section modulus and result of stiffness in flexure viewed from end to end 13 of the table 12.

Figure 11:
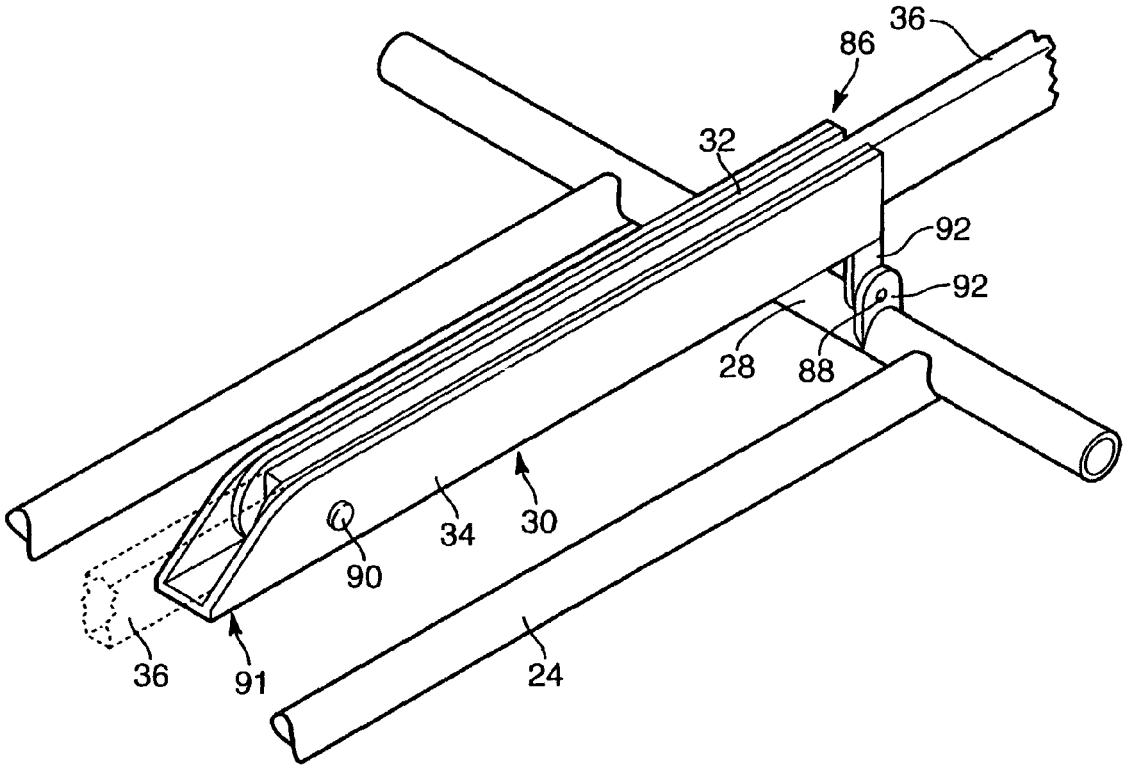
FIG. 11 is a perspective view of one alternative embodiment of a self-stabilizing collapsible brace or diagonal for supporting a bench or table pedestal.

Referring to FIG. 11, a brace 30 may be formed to nest about the rail 36. The brace 30 may also be used as a brace 50, and may accommodate a rail 56 for the bench 14. As a practical matter, pivots 86, 88, 90 may be provided for breaking the brace 30 into a lower piece 34 associated with the pedestal 24, 44, and an upper piece 32 associated with the table top 20 or rail 36. Correspondingly, the upper piece 32 in a brace 50 may correspond to a rail 56 or stringer 56 of a bench 14, or simply a bracket 80 attached to a bench top 21. Meanwhile, the lower piece 34 may be one or more pieces, and may be a rail 34, a yoke 34 into two pieces 34, or the like as described and illustrated above, for securing the upper piece 32 to legs 24, 44 or foot 28, 48 of the respective table 12 or bench 14. The pivots 86, 88, 90 may be formed in anyone of several suitable manners. In one embodiment, a rivet may be secured to a surface, and left to pivot within an aperture in another surface. Thus, the pivots 86, 88, 90 may be made virtually flush with the surfaces of the pieces 32, 34.

A lock, or stabilizer 91 may support the pieces 32, 34 with respect to one another and stabilize them with respect to one another. Various mechanisms known in the art are available for locking the pivot 90 to form a rigid brace 30, 50 made of the upper piece 32 and lower piece 34.

Figure 12A:
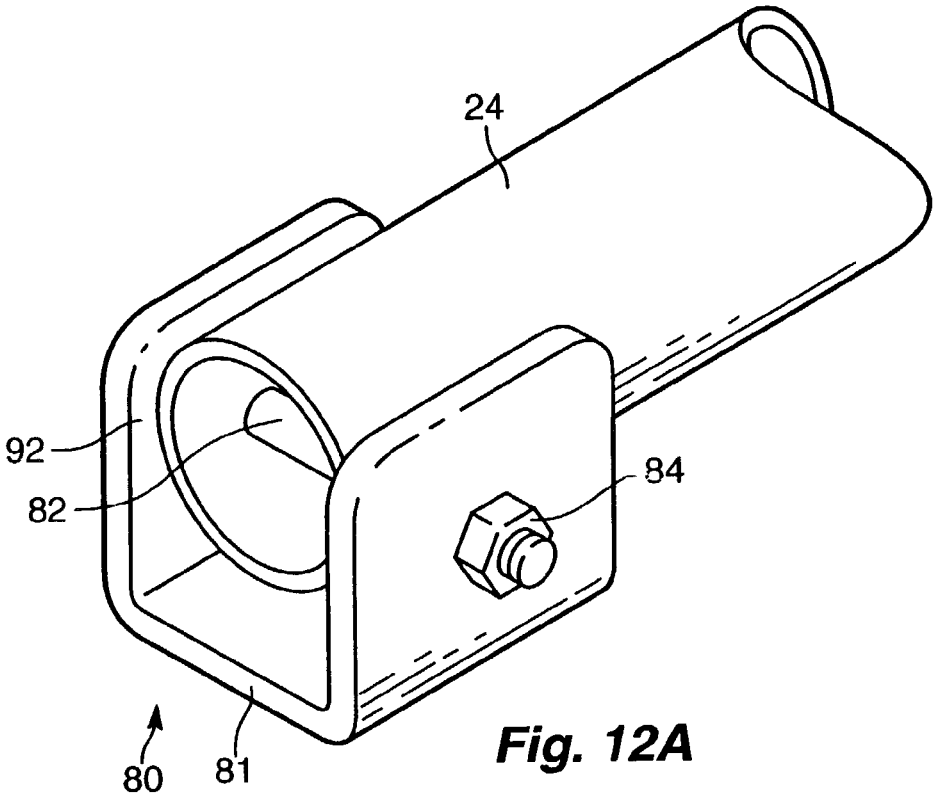
Figure 12B:
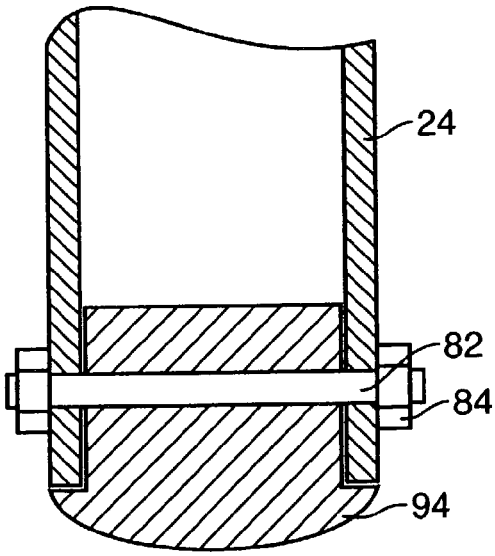

Referring to FIG. 12, a bracket 80 may include a mount 81 or mounting surface 81 for securing to a table 12 or bench 14, such as a table top 20 or bench top 21. Ears 92 or a clevis 92 may be formed to receive an axle 82. The axle 82 may be secured by a rivet head or nut 84 or other securement structure 84. A leg 24 may extend into the bracket 80 between the ears 92 or clevis 92. Accordingly, a leg 24, 44 may pivot about an axle 82 as desired. A brace 30, 50 may secure a leg 24, 44 of a table 12 or a bench 14. In the illustration of FIG. 11, the ears 92 or clevis 92 may be secured with a pivot 88 to a foot 28 of a pedestal 22. Nevertheless, the brace 30, 50 may be secured as one or two pieces directly to the leg 24, 44 or legs 24, 44 of the table 12 or bench 14, respectively.

Referring to FIGS. 13A–13D, while continuing to refer generally to FIGS. 1–14, numerous mechanisms may be embodied for securing the bench top 21 or bench 14 within the envelope of the table top 20 or table 12. In one embodiment, a detent 100 may be formed to capture each side of a bench top 21 or bench 14. The detents 100 may be formed in the table top 20 as ledges or the like to be defomlable to deflect sufficiently to receive the bench top 21 or entire bench 14, closing in therebehind to secure the bench top 21 or bench 14 within the cavity 69. Each of the views of FIGS. 13A–13D represents a partial, cutaway, end, elevation, cross-sectional view of a table top 20 of a table 12 and a bench top 21 of a bench 14. The interference 104 of the detent 100 with the bench top 21 provides the latching mechanism. Nevertheless, application with suitable force, greater than the weight of the bench 14 may dislodge the bench top 21 or bench 14 by deforming the detents 100 sufficient to neutralize the interference 104.

Figure 13A:
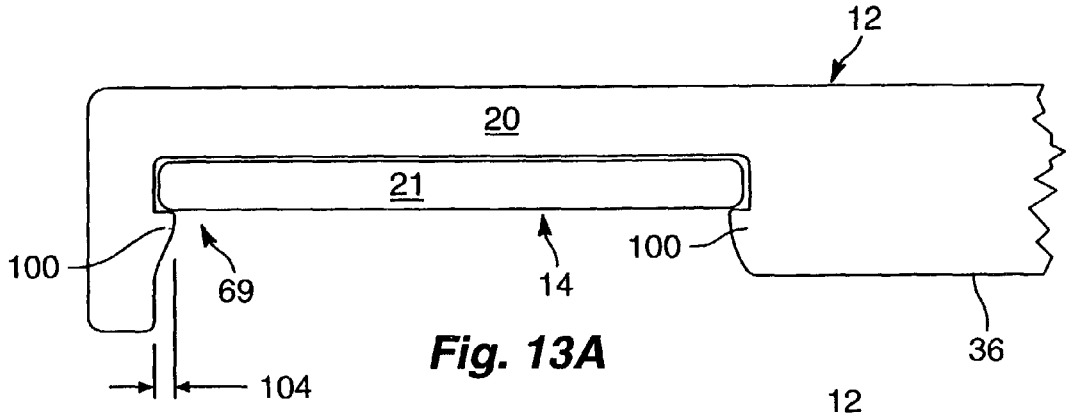
FIGS. 13A–13D are end, elevation, cross-sectional views of alternative embodiments for securing the bench within the table envelope.
Figure 13B:
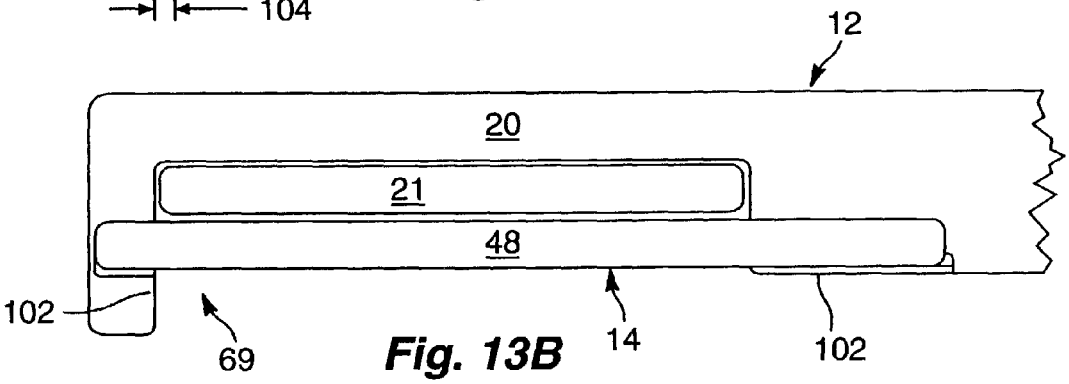

Referring specifically to FIG. 13B, detents 102 may be formed in frame 16 of the table top 20 for receiving the foot 48 of a bench 14. Detents 102 may be formed near the outside or inside portions of a table top 20. For example, in the To embodiments of FIGS. 13A–13D, the rail 36 is not a distinct metal rail necessarily, but may merely be an increased section of the table top 20. The detents 102 may act in approximately the same manner as the detents 100 may operate in an orthogonal direction.

Figure 13C:
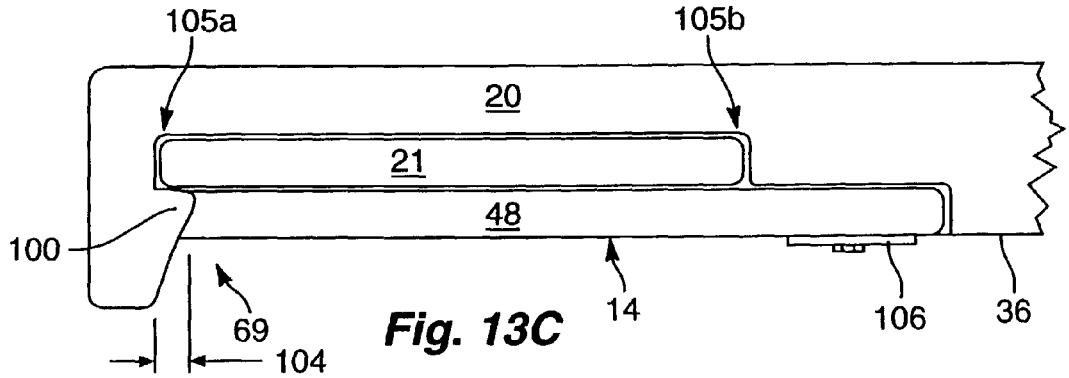

Referring to FIGS. 13C, a detent 100 may be formed to have a substantial interference 104 that cannot be deformed. Instead, placement of a bench top 21 may involve placing one side 105*a* of the bench top 21 into the cavity 69 above the detent 100. The bench top may be rotated into position at an opposite side 105*b* to be received into the cavity 69. Meanwhile, some form of latch 106 or latching mechanism 106 may be adapted to secure the foot 48 or the bench top 21 in the cavity 69. Thus, the detent 100 of FIG. 13C may form a shelf such that a single latch 106 may secure a foot 48.

Figure 13D:
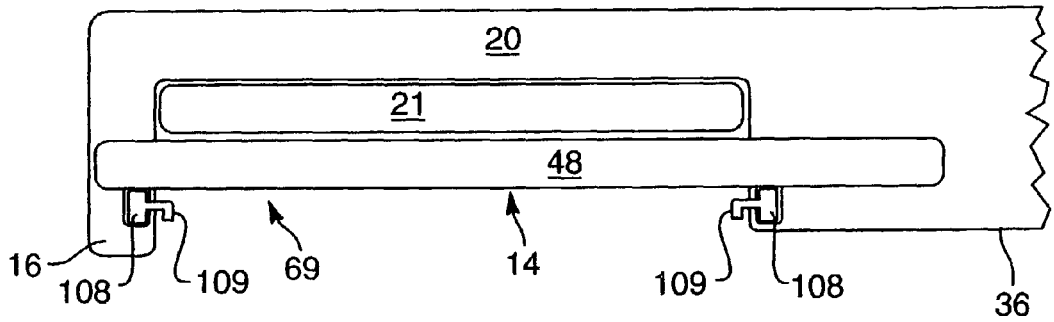

Referring to FIG. 13D, in one embodiment, a slide 108 may be used, operating similarly to a deadbolt. For example, a handle 109 may be formed to be fixed with respect to a slide 108 running in a longitudinal direction along a frame 16 of a table top 20. The slide 108 may move away from a foot 48 to release the foot, and leave the bench 14 free to removed. Meanwhile, a slide 108 may be moved to interfere partially or completely with movement of the foot 48. Thus, a bench 14 may be positively secured within a cavity 69 of a table top 20.

Referring to FIGS. 14A–14E, various types of latching mechanisms 106, 108 are illustrated. For example, a latch 106 may rotate about a pivot 107 to engage a foot 28, 48. Alternatively, referring to FIG. 14B particularly, FIGS. 14A–14D generally, and continuing to refer to FIGS. 1–14, a latch 108 may be captured within a guide 109 or weigh 109 to move in a direction 111 transverse to a foot 28, 48 or a leg 24, 44 or even a pedestal 22, 42, generally. Thus, a latch 108 may slide in a direction 111 across a foot 28, 48 securing the pedestal 22, 42 and bench 14 within the cavity 69 of a table top 20.

Figure 14A:
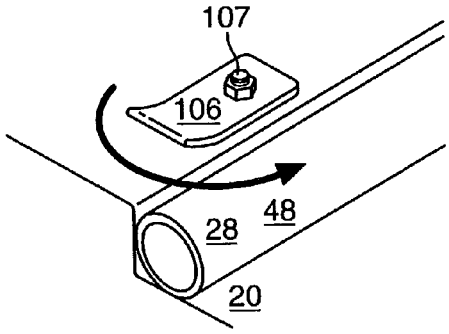
Figure 14B:
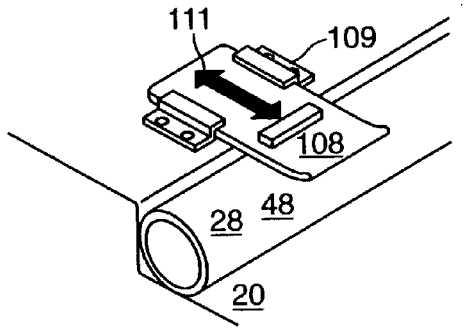
Figure 14C:
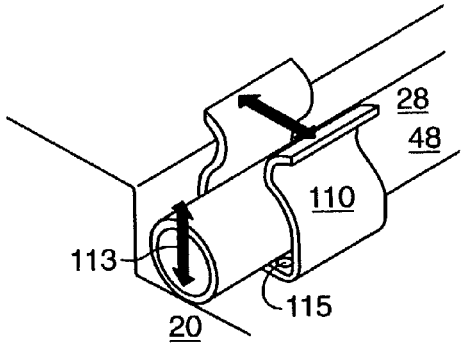

Referring to FIG. 14C, a clip 110 may be formed of a plastic, or a metal to spring away and back in response to forces applied by a user. For example, a user may apply a force in a direction 113 transverse to a longitudinal direction of a foot 28, 48 in order to urge the spring clip 110 to move in a transverse direction 111. The shape of a clip 110 may be designed to be secured by fasteners 115 to a table top 20 in a desired location. Accordingly, a foot 28, 48 or a leg 24, 44 may be received within the clip 110 securely. Application of a suitable force by a user may open the clip 110 releasing the foot 28, 48 or leg 24, 44.

Figure 14D:
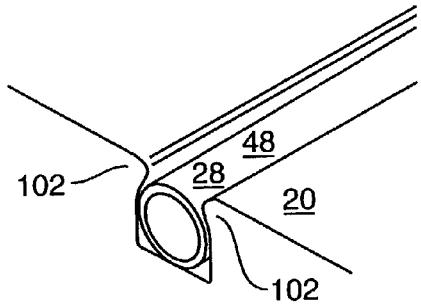

Referring to FIG. 14D, an alternative embodiment of a detent 102 is illustrated in which, the actual detent 102 is formed to operate as a clip 110 of FIG. 14C. Accordingly, the detents 102 may operate to move in a direction 111 in response to a force applied by a user in a direction 113 urging a foot 28, 48 or leg 24, 44 in the direction 113. Thus, the detent 102 may deflect in a direction 111 when acted upon by a user. Meanwhile, the detents 102 secure a foot 28, 48 or leg 24, 44 within the envelope of the table top 20.

Figure 14E:
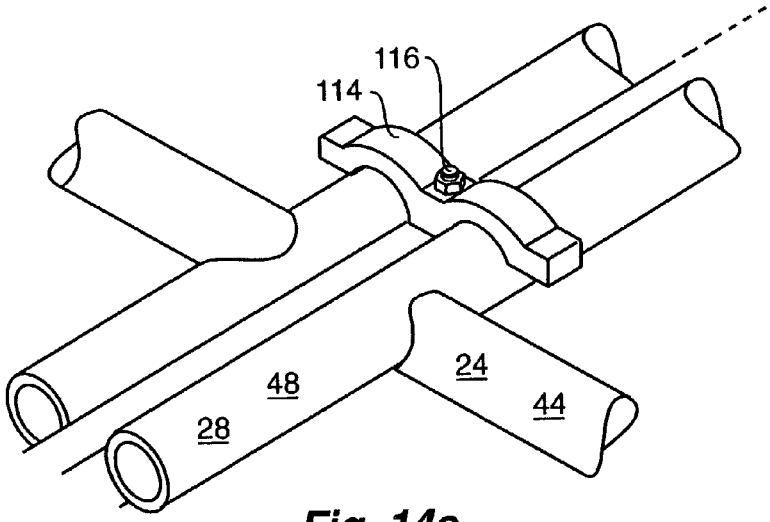

Referring to FIG. 14E, a yoke 114 may be designed to fit on a fastener 116. A fastener 116 may be spring loaded, or may be threaded or latched in some other way. The yoke 114 may be selectively turned to release and capture one or more feet 28, 48 similarly, a latch 114 or yoke 114 may be designed to fit between a pair of legs 24, 44 of a table 12 or bench 14. Rotation of the yoke 114 about a fastener 116 may affect extension of the fastener 116, if spring-loaded or may be ineffectual, if the fastener 116 is rigid. A rigid fastener 116 may require a wing nut or the like to release the yoke 114 a distance sufficient to rotate about the fastener 116 to selectively release or engage the foot 28, 48 or leg 24, 44.

In general, it may be seen that a table apparatus 10 in accordance with invention may be fabricated to secure benches nested within the envelope of a table top. Meanwhile, the benches may be formed of wood, metal, plastic, and the like. A table top may be formed by any of several mechanisms from a resin (polymers), metal, or wood. In one, presently preferred, lightweight embodiment, the tables and benches may be formed of plastic in a hollow structure. The hollow structure may be filled with foam where desired, and left evacuated where desired. Double walls, single walls, and the like may be used to form the table top 20 and the bench top 21. Cavities and recesses may be formed at will within the bottom surface of the table top 20, and the bottom surface of the bench top 21. Accordingly, the legs may be accommodated with brackets 80 formed into the table top 20 and bench top 21, or may have metal or other material selected for forming brackets to be attached to a table top 20 or bench or bench top 21, respectively. In one presently preferred embodiment, an apparatus and method in accordance with the invention may be formed to be carried by a single individual. Two individuals may easily carry a nested pair of benches 14 within a table 12. The single individual may deploy the benches 14 and the table 12 once positioned in an area for use.

From the above discussion, it will be appreciated that the present invention provides a table and bench system 10, in which each bench 14 is separately deployable from the other bench 14, and from the table 12. The benches 14 are separable from one another and from the table 12. The benches 14 may be nested alone or together within the table 12. A recess formed in the table top 20 may provide for storage of the benches 14 within the overall envelope of the table top 20. The table 12 may be used with full functionality with the benches stored within the table envelope, or with the benches deployed, removed, or positioned elsewhere for other uses. The benches 14, may be separately useable without the tables, by removal from their nested locations in a cavity 69 of a table 12. The entire bench 14 is collapsible for storage. The entire table 14 is collapsible for storage. The benches 14 are collapsible within the table structure 12 for storage. Nevertheless, the benches 14 and the table 12 do not require each other for any structural mechanism for support during deployment and use.

Figure 15:
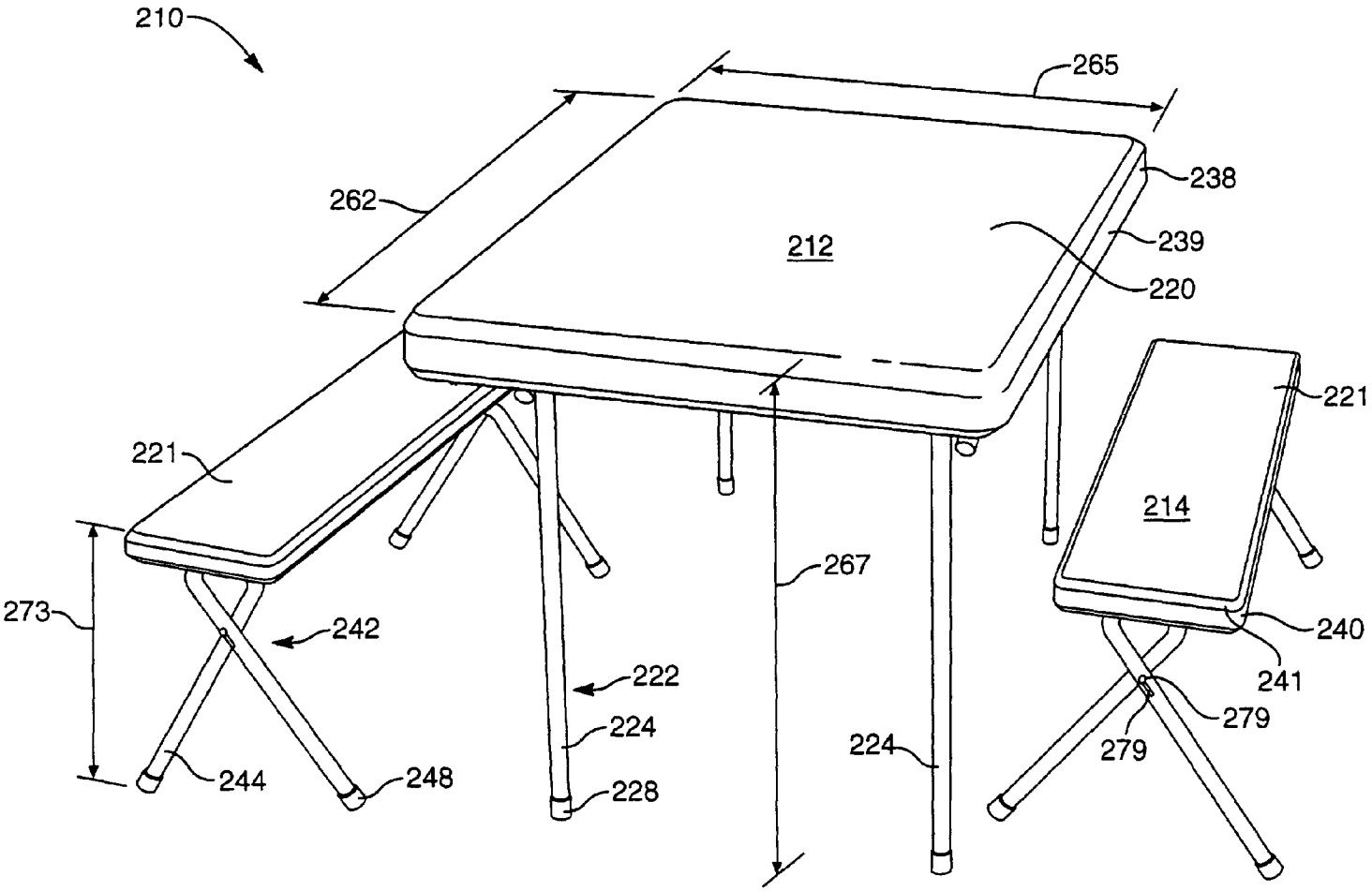
FIG. 15 is a perspective view of an alternate embodiment of the collapsible table of the present invention.

Referring now to FIG. 15, and generally to FIGS. 15-19, an alternate preferred embodiment of an apparatus 210 may be formed to include a collapsible table 212 and a seating member 214. Preferably, multiple seating members 214 may be included in one presently preferred embodiment. The table 212 may be constructed to have a support frame 216 and the seating member 214 may also be constructed to include a support frame 218.

In one embodiment of the apparatus 210, the frame 216, 218 of the table 212 and the seating member 214, respectively, may be formed of metal, using a method such as an extrusion. A table top 220, a bench seat 221, or both may be formed as single pieces which include the respective frames 216, 218 using a method or technique such as stamping. In another embodiment, the table top 220 and bench seat 221 may be formed of expanded metal. Moreover, a reinforced, crimped, solid sheet may be used, stiffened with proper changes in section modulus by corrugation, and the like.

Alternatively, in certain embodiments, the table top 220 and bench seat 221 may be formed of wood, with a rail as the frame 216, 218, respectively. In the illustrated embodiment of FIG. 16, the entire frame 216 of the table 212, including the table top 220, may be made of a resin formed by a process such as blow-molding, injection-molding, vacuum-forming, tumble-molding, or the like. Similarly, the seating member 214 and, more particularly, the frame 218 and bench seat 221, may be formed by any of the same or other methods practiced in the art. As appreciated, however, it is not required that the table 212 and the seating member 214 are manufactured using the same process.

Preferably, lightweight plastic structures may be formed to render the table 212 and seating members 214 readily transportable. Inasmuch as an easy deployment is desirable, and a simple collapse and storage of the apparatus 210 is desirable, for any table 212 and seating member 214, plastic resins are preferred in those certain embodiments. Moreover, minimizing the number of persons required and the strength required of anyone or more persons to deploy or collapse the table 212, the seating member 214, or both is very desirable. Therefore, hollow, lightweight structures are preferred, and may be more readily available by such forming methods as stamping of metals, vacuum forming of resin sheets, blow-molding of hollow structures, and tumble-molding of complex, hollow resin structures.

Figure 16:
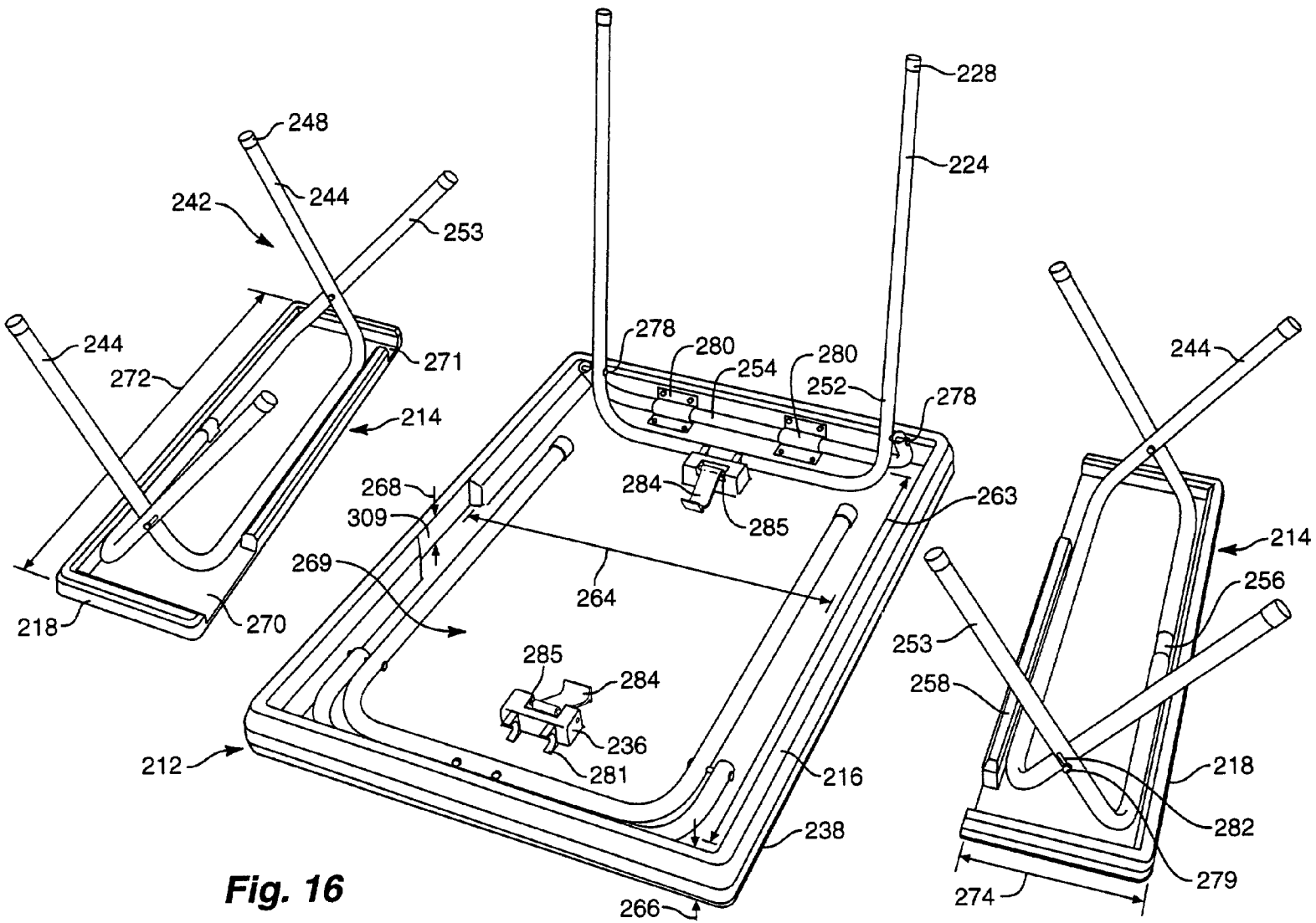
FIG. 16 is a perspective view of one presently preferred embodiment of the underside of the table and the underside of the seat members of the embodiment of FIG. 15 with one of the two support pedestals of the table selectively disposed in a collapsed position.

Referring to FIG. 15, a pedestal 222 of the table 212 supports the table top 220 above a surface. A pedestal 222 is preferably formed at opposing ends of the table 212, wherein the pedestal 222 comprises one or more support legs 224. In one presently preferred embodiment of the present invention, the pedestals 222 include a single leg 224 having a general V-shaped configuration and formed of round tubing, as best shown in FIG. 16. In other embodiments, the pedestal 222 may be formed from tubing of a different cross-sectional shape, such as a square or other geometrical configuration sufficient to provide adequate structural integrity to the table top 220 when the table 212 is disposed in an upright position. In still other preferred embodiments, the pedestal 222 may be formed from other sufficiently sturdy materials such as plastic, fiberglass, wood, or the like. Steel tubing also may be used to form the pedestal 222 because of its strong and inherent lightweight properties.

To maximize strength and stability, while minimizing the weight of the collapsible table 212, the opposing ends of the legs 24 of the pedestals 222 are spaced apart from each other. As best shown in FIGS. 15 and 16, a foot 228 may be provided at a first end of each of the opposing ends of the legs 24 of the pedestals 222 to assist in supporting the table 212 on a surface, such as a lawn, patio, the ground, floor surface, or the like. In one presently preferred embodiment, the foot 228 maybe formed of plastic, rubber, or metallic material that is configured to engage the opposing ends of each of the legs 24. Moreover, "floatation" may be provided in that the foot 228 may distribute stress on an underlying surface, thereby preventing sinking of either opposing end of the legs 244 into the ground, for example. The foot 228 may also provide easy sliding of the foot 228 on the surface supporting the table 212 when disposed in the upright position.

Still referring to FIGS. 15 and 16, each of the seating members 214 include a seat support member 242 having one or more legs 244. In one presently preferred embodiment, the seat support member 242 includes at least two legs 244, 253, wherein each leg 244, 253 may be configured having a general V-shaped configuration and formed from round tubing. In other presently preferred embodiments, the seat support member 242 may be formed from tubing of a different cross-sectional shape, such as a square or other geometrical configuration sufficient to provide adequate structural integrity to the seat support member 242 when the seating member 214 is disposed in an upright position. In still other embodiments, the seat support members 242 may be formed from other sufficiently sturdy materials such as plastic, fiberglass, wood, or the like. Steel tubing also may be used to form the seat support members 242 because of its preferred strength to weight ratio.

Structurally, each of the legs 244 may be selectively positioned to project substantially outward from the underside of the seat support member 242. In one presently preferred embodiment, the legs 244 may be formed having a foot 248 secured at each of the opposing ends of the legs 244. Similar to the foot 228 preferably adapted to engage the opposing ends of the leg 224 of the pedestals 222 of the table 212, the foot 248 may be formed of plastic, rubber, or metallic material that is configured to engage the opposing ends of each of the legs 244. Moreover, "floatation" may be provided in that the foot 248 may distribute stress on an underlying surface, thereby preventing sinking of either opposing end of the legs 244 into the ground, for example. The foot 248 may also provide easy sliding of the foot 248 on the surface supporting the seating member 214 when disposed in an upright position.

A rim 238 is preferably formed to extend about the perimeter of the table top 220. Structurally, the rim 238 adds section modulus to the table top 220 by extending the outermost fiber, in engineering terms, to a maximum distance away from a neutral axis (e.g., center with respect to a load). Similarly, the section modulus of the table top 220 may be increased by adding a beveled edge 239 between the table top 220 and the rim 238.

Likewise, a rim 240 may be formed to extend about the perimeter of the seating member 214. The rim 240 would therefore add section modulus to the seating member 214 in the same manner as the rim 238 adds section modulus to the table top 220. Correspondingly, the section modulus of the bench seat 221 of the seating member 214 may be increased by adding a beveled edge 241 between the bench seat 221 and the rim 240 of the seating member 214.

Referring now specifically to FIG. 15, a length 262 of an outer envelope of the table 212 may be selected to accommodate one or more users. As will be appreciated, certain ergonomic factors may be used to design the length 262 in order to accommodate a specific number of users. For example, a table 212 of the present invention may be designed to provide a specific distance or space for each user and for a specific number of users, depending on some preselected comfort factor, as a width suitable for each average person. Accordingly, the length 262 may be a multiple of a width of a theoretical single individual.

A width 265 of an outer envelope of the table 212 may be selected to meet ergonomic criteria, similar to those selected for the length 262. For example, sufficient width 265 may be provided such that a user may be seated at an end of the table top 220. Accordingly, the width 265 may be selected to accommodate a user at opposing ends of the table 212 without displacing other users along the length 262 of the table top 220.

Referring now to FIG. 16, a length 263 and a width 264 inside the table 212 may be selected to fit one or more seating members 214 therein. In addition, the length 263 and width 264 may be selected to accommodate any hardware structures. The size and configuration of the seating members 214 are therefore configured in such a manner so as to be selectively accommodated within the length 263 and width 264 of the table 212 to preferably facilitate complete nesting of the seating members 214 within an internal envelope of the table 212.

The thickness 266 of the outside of the envelope of the table top 220 may be determined by the section modulus or stiffness required to sufficiently support a load on the rim 238 of the table 212. Also, the thickness 266 may be determined by the size of a user seated on a seating member 214, along with the proper altitude 267 for positioning the table top 220 in relation to the seating member 214 and an underlying surface. A thickness 268 of the interior of the envelope of the table 212 is preferably formed having sufficient dimension to retain the pedestals 222 of the table 212 and at least one seating member 214, together with the seat support member 242 thereof. Moreover, in one presently preferred embodiment, the thickness 268 of the interior envelope of the table 212 has a dimensional thickness 268 sufficient for retaining the pedestals 222 of the table 212 and at two seating members 214. The thickness 268 of the interior cavity 269 of the table 212 may also be configured in dimension to secure any of the hardware of the table 212 and the seating member 214 desired during storage, deployment, or both.

Figure 17:
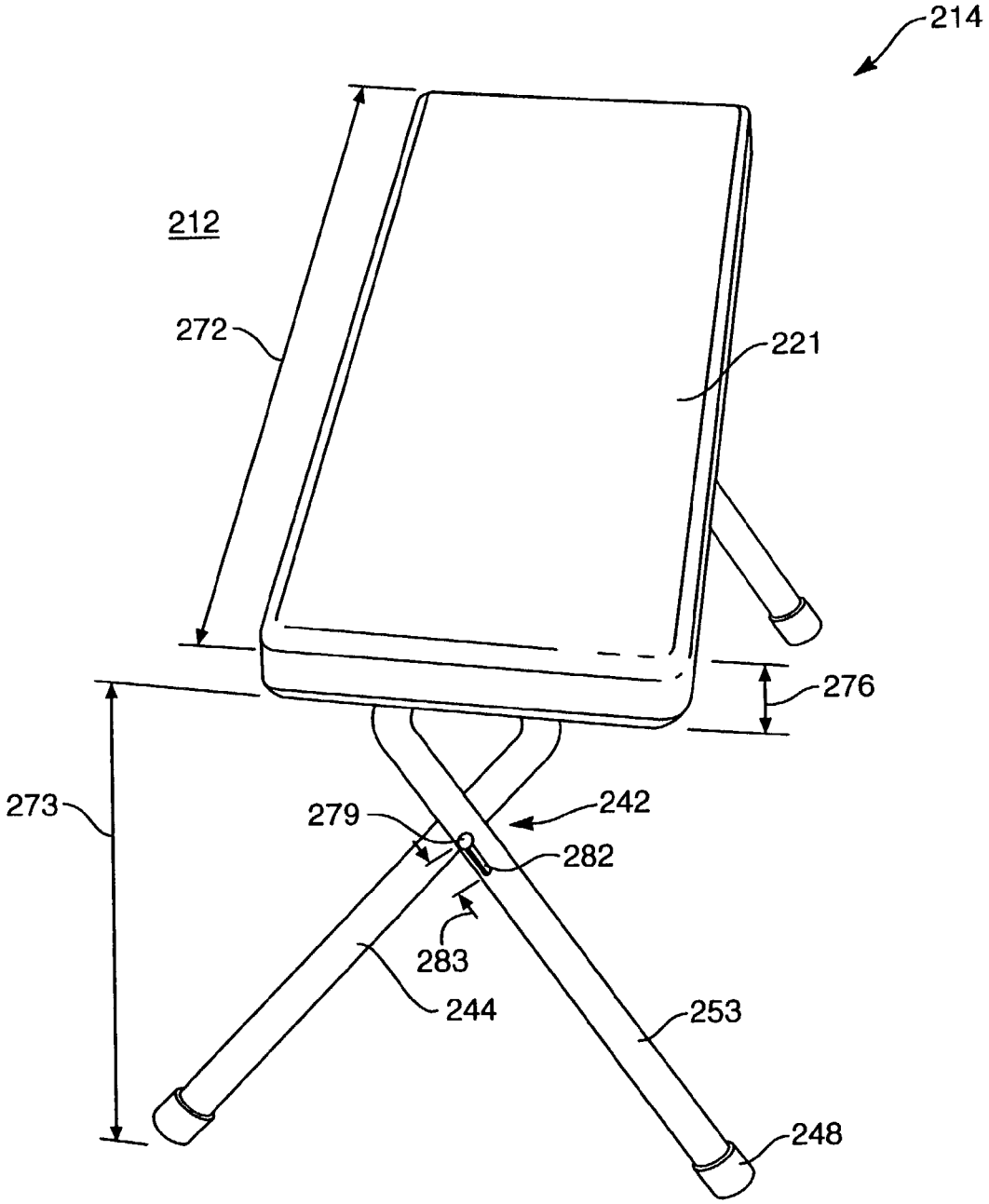
FIG. 17 is a front-end view of one presently preferred embodiment of a seat member of the embodiment of FIG. 15 illustrating support legs of the seat member, wherein one of the support legs is configured to be slidably adjusted relative to the other support leg.
Figure 18:
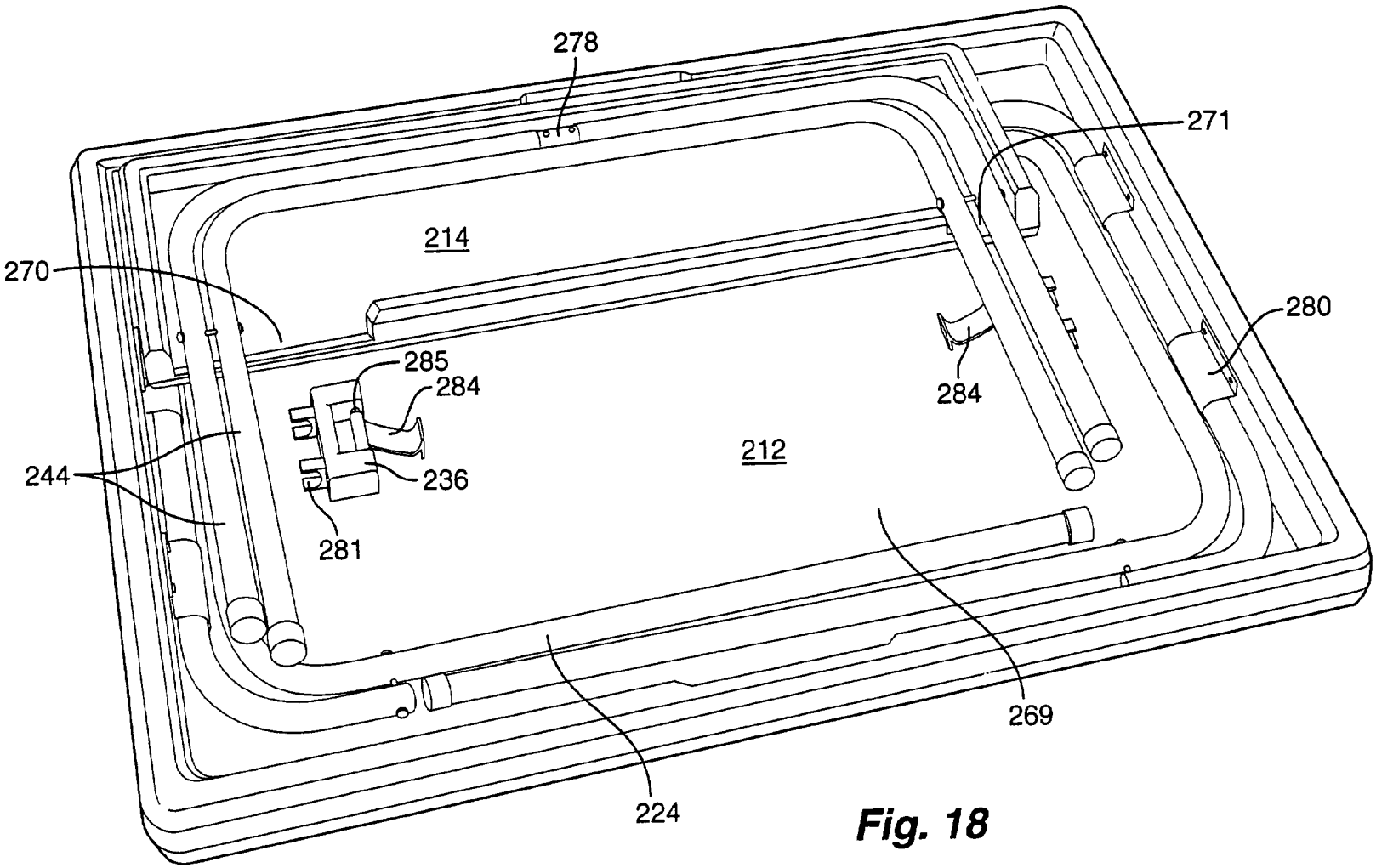
FIG. 18 is a perspective view of the underside of the table of the embodiment of FIG. 15 illustrating the support pedestals of the table disposed in the collapsed position and one of the seat members positioned within the cavity of the table top and selectively secured therein.

Correspondingly, the thickness 276 of each seating member 214 may be selected to provide the proper strength and stiffness for comfortably supporting one or more users thereon which also correlates to the length 272 of the seating member 214, as best shown in FIG. 17. The length 272 of the seating member 214 and the height 273 of the seating member 214 in relation to an underlying surface may be selected to comfortably seat one or more users. The length 272 of the seating member 214 should also be selected such that it may be selectively introduced within the length 263 of the interior cavity 269 of the envelope of the table 212, as shown in FIG. 18.

Referring now to FIG. 16, and generally to FIGS. 15-17, the supportable attachment of the pedestal 222 to the table 212 and the seat support member 242 to the seating member 214 maybe accomplished by a variety of methods. In one presently preferred embodiment, a bracket 280 is configured to securely engage the pedestal 222 in pivotal relationship to the underside of the table top 220. As discussed above, the pedestals 222 of the table 212 are preferably formed having a first support leg 224 comprising a general U-shaped configuration and including two opposing ends. Disposed in relation to the first support leg 224 is a second support leg 254 that is pivotally mounted to the underside of the table top 220 by at least one bracket 280. Preferably, two brackets 280 are positioned at a spaced apart distance from each other and securely engage at least a portion of the second support leg 254 in pivotal relation to the table top 220.

In one preferred embodiment, the second support leg 254 may be formed having a general V-shaped configuration and comprising opposing ends that are adapted to pivotally engage the corresponding portions of the first support leg 224. A pivot pin 278 may be operably disposed in pivotal engagement between the first support leg 224 and the second support leg 254 of the pedestal 222. In operation, the fixed relationship of the second support leg 254 in relation to the underside of the table top 220 and the pivotal relationship between the first support leg 224 and the second support leg 254 facilitates the selective disposition extended position such that the table 212 is disposed in an upright position and a retracted position such that the table 212 is disposed in a collapsed position.

As best shown in FIG. 16, when a pedestal 222 is selectively disposed in the extended position by means of the pivotal engagement between the pedestal 222 and the table 212, the pedestal 222 may be retained in the extended position by a fastener 281. In one presently preferred embodiment, the fastener 281 selectively engages a portion of the first support leg 224 and thereby retains the pedestal 222 in a fixed relationship to the table 212 when positioning the table in the upright position, as illustrated in FIG. 15. In addition, the fastener 281 may be supportably disposed in relation to a support brace 236 rigidly secured to the underside of the table top 220. In preferred operation, the support brace 236 may act as a structural abutment that the portion of the first support leg 224 may rest against when engaged by the fastener 281, thus giving greater structural integrity to the table 212 when disposed in the upright position. As will be appreciated, the support brace 236 may be varied in size and shape to achieve the desired level of support required for supporting the pedestal 222 in relation to a load acting against the table top 220 when the table 212 is positioned in the upright position.

In one presently preferred embodiment as illustrated in FIG. 16, the fastener 281 comprises a general V-shaped configuration and includes two opposing ends that provide sufficient biasing against the engaging portion of the first support leg 224 of the pedestal when selectively retaining the support leg 224 in engagement therewith. As shown in FIG. 16, the fastener 281 may include one or more friction-fit fasteners. It will be appreciated, that one or more fasteners, a series of clamps, a bolt and nut assembly, or any similar fastener may be used. Accordingly, it will readily be appreciated by those skilled in the art that the fastener 281 shown in the Figures is merely illustrative of one presently preferred embodiment and is not intended to be restrictive thereof.

When selectively positioning the pedestal 222 from the extended position to the retracted position, the first support leg 224 may be dislodged from its selective engagement with the fastener 281 such that the first support leg 224 and the second support leg 254 pivot about the axis of the pivot pin 278 in such a manner so as to nest within the internal periphery of the envelope of the table 212. As will be appreciated, depending upon the length 263 of the interior cavity 269 of the table 212, the opposing ends of each of the first support legs 224 of the pedestals 222 may be disposed in such a manner so as to be offset from each other when introduced into the interior cavity 269 of the table 212. Preferably, when the pedestals 222 are positioned in the retracted position, the first and second support legs 224, 254 sufficiently nest within the interior cavity 269 of the envelope of the table 212.

The brackets 280 that selectively engage and retain the first support leg 224 of each of the opposing pedestal 222 may be formed aspal1 of the frame 216 of the table 212 or, in the alternative, may be formed as separate parts. In one presently preferred embodiment, the brackets 280 are formed of a sufficiently rigid material (i.e. metal, fiberglass, wood, plastic, or the like) and preferably comprise a first arm secured to the underside of the table 212 and a second opposing arm secured to an internal portion of rim 238.

Referring specifically to FIGS. 16 and 17, in one presently preferred embodiment, the seating members 214 are each supported by a seat support member 242. The seat support member 242 is preferably formed having a first support leg 244 and a second support leg 253. Each of the support legs 244, 253 may be configured having a general V-shaped configuration, thus comprising two opposing ends. In one presently preferred embodiment, the support legs 244, 253 are formed having nearly identical dimensional proportions. The second support leg 253, however, may be formed having a slightly longer midsection disposed between its opposing ends such that the first support leg 244 may substantially fit within the interior of the second support leg 253 when the seat support member 242 is selectively positioned in the retracted position, as best shown in FIG. 18.

Referring back to FIG. 16, the supportable attachment of the seat support member 242 to the seating member 214 may be accomplished by a variety of methods. In one presently preferred embodiment, a bracket 256 is configured to securely engage the second support leg 253 of the seat support member 242 in pivotal relationship to the underside the bench seat 221 and/or the support frame 218. The bracket 256 that selectively engages and retains the second support leg 253 to the bench seat 221 may be formed as part of the frame 218 or, in the alternative, may be formed as a separate part. In one presently preferred embodiment, the bracket 256 comprises a sufficiently rigid material (i.e., metal, fiberglass, wood, plastic, or the like) and preferably comprises a first arm and a second arm secured to the underside of the bench seat 221 and an intermediate portion configured to engage a portion of the length of the midsection of the second support leg 253. It will readily be appreciated that one or more brackets 256 may be provided so as to sufficiently retain the second support leg 253 in pivotal relation to the bench seat 221.

In one presently preferred embodiment, the second support leg 253 is formed having a general V-shaped configuration and comprises opposing ends that are adapted to pivotally engage the corresponding opposing ends of the first support leg 244. Preferably, a pivot pin 279 may be operably disposed in pivotal engagement between the first support leg 244 and the second support leg 253 of the seat support member 242. In operation, the fixed relationship of the second support leg 253 to the underside of the bench seat 221 and the pivotal connection between the second support leg 253 and the first support leg 244 facilitates the selective disposition of the seat support member 242 between an extended position such that the seating member 214 is disposed in an extended position and a retracted position such that the seating member 214 is disposed in a collapsed position.

As best shown in FIG. 16, when a seat support member 242 is selectively disposed in the extended position by means of the pivotal engagement between the seat support member 242 and the seating member 214, the second support leg 253 of the seat support member 242 may be supportably disposed in the extended position in such a manner so as to act against an elongated support brace 258. Structurally, the support brace 258 provides a structural abutment that a portion of the second support leg 253 may rest there against. In preferred design, the support brace 258 provides structural integrity to the seat support member 242 when the seating member 214 is disposed in the upright position. As will be appreciated, the support brace 258 may be varied in size and shape to achieve the desired level of support required for supporting the seat support member 242 in relation to a load acting on the seating member 214 when positioned in the upright position.

As discussed above, the second support leg 253 is preferably formed having a longer midsection between its opposing ends such that the first support leg 244 may substantially fit within the internal periphery of the second support leg 253 when the seat support member 242 is positioned in the retracted position. One presently preferred structural arrangement between the support legs 244, 253 of the seat support member 242 may include an elongated slot 282 formed in a section of the length of the second support leg 253, as best shown in FIG. 17. The slot 282 is preferably formed having a dimensional length 283 that is greater than or equal to the diameter of the first support leg 244. In addition, a slidable locking pin 279 may be operably disposed between both support legs 244, 253 to facilitate an adjustable engagement therebetween. The locking pin 279 includes a head and an elongated body sufficient to pass through both support legs 244, 253. The head of the locking pin 279 preferably comprises a diameter greater than the width of the slot 282 so as to selectively travel within the length of the slot 282. For example, when the seat support member 242 is moved from the extended position into the retracted position, the locking pin 279 preferably slides within the slot 282 to an opposing end thereof. Accordingly, the first support leg 244 may be manipulated into a position where it substantially nests against the underside of the bench seat 221 and within the internal periphery of the second support leg 253, as shown in FIG. 18.

Referring back to FIG. 16, in one presently preferred embodiment of the present invention, when the seating member 214 is positioned in the extended position, the first support leg 244 may be supported by the elongated support brace 258 and the second support leg 253 may be supported by the bracket 256 and the rim 218 of the seating member 214 opposite the support brace 258. As will be appreciated by those skilled in the art, the support brace 258 may comprise a clamp, bolt, or other type of conventional fastener or retaining assembly.

Still referring to FIG. 16, and to FIGS. 15-19 generally, the table 212 is formed having an internal cavity 269 sufficient in dimensional size to nest one or more seating members 214 within the envelope thereof. As will be appreciated by those skilled in the art, one or more cavities 269 may be formed within the envelope of the underside of the table top 220, if desired. Moreover, a handle 309 may be formed in the underside of table top 220 to assist a user in manipulating the table 212. For example, a recess 309 may be formed in the peripheral frame 216 of the table 212, as illustrated in FIG. 16. The handle 309 may also consist of any conventional handle such as, for example, a separate piece of fabric, leather, plastic, wood, or the like, securely attached to the table 212.

A perspective view of the underside of the table top 220 of the table 212 is illustrated in FIG. 18, wherein the underside of the table top 220 is shown with the pedestals 222 of the table 212 selectively positioned in the retracted position within the interior cavity 269 of the envelope of the table top 220. A seating member 214 having the seat support member 242 selectively positioned in the retracted position may be introduced within the interior cavity 269 of the envelope of the table top 220 adjacent one side of the frame 216 of the table 212. As shown, the seating member 214 rests within a portion of the interior cavity 269 and abuts part of the pedestals 222 of the table 212, thereby providing a means for retaining the pedestals 222 within the interior cavity 269 of the table top 220.

As best shown in FIG. 18, a retaining member 284 pivotally engages the support brace 236 that is securely attached to the underside of the table top 220. In one presently preferred embodiment, the retaining member 284 comprises a first end pivotally engaging the support brace 236 by means of a pivot pin 285 arrangement. In addition, the retaining member 284 includes a second opposing end and an intermediate portion having a general arcuate shape configured to selectively engage a section of the first support leg 244 of the seat support member 242 at the second end, as best shown in FIGS. 18 and 19.

Figure 19:
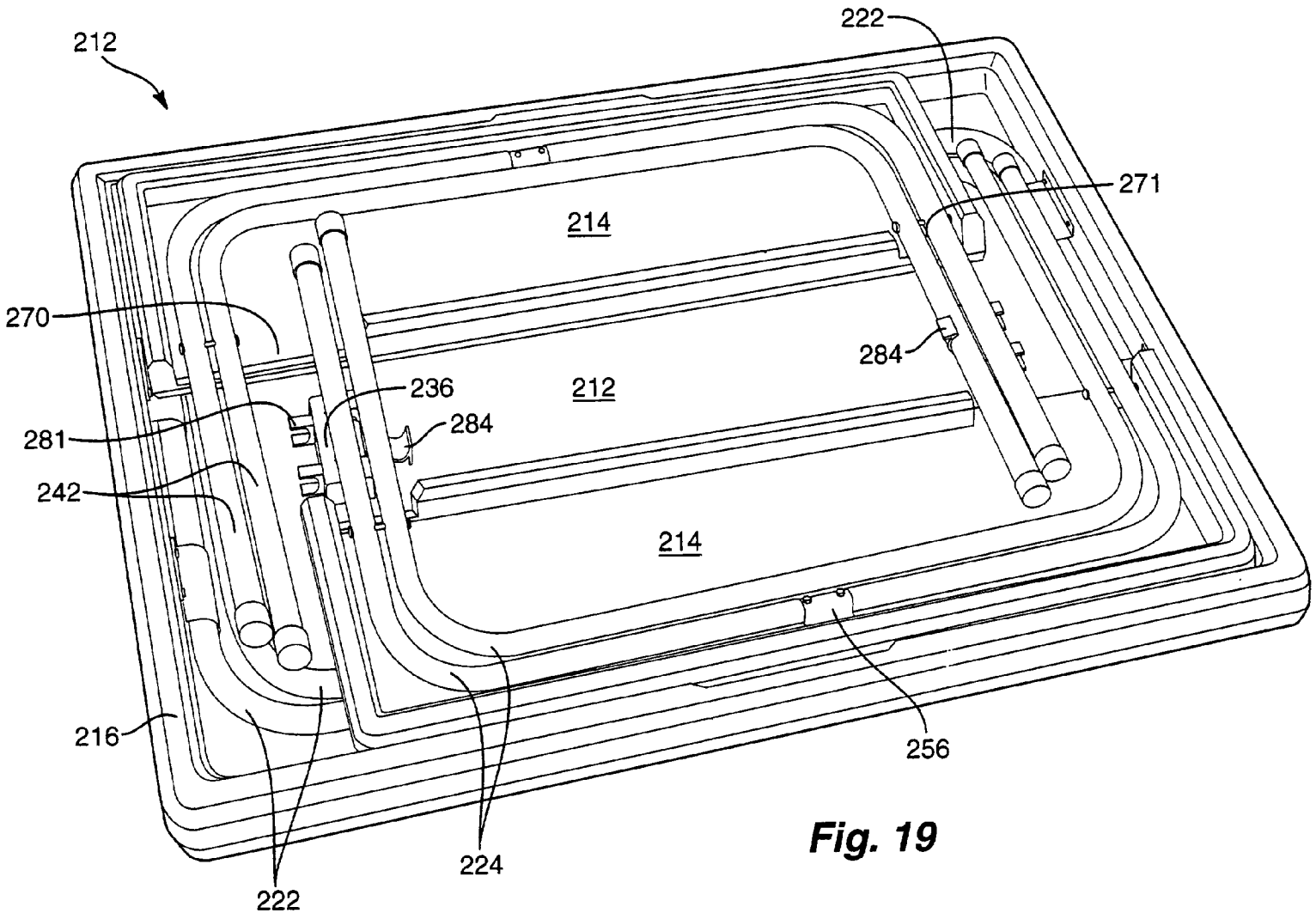
FIG. 19 is a perspective view of the underside of the table of the embodiment of FIG. 15 illustrating the support pedestals of the table disposed in the collapsed position and the seat members positioned within the cavity of the table top and selectively secured therein.

Referring now to FIG. 19, the remaining seating member 214 having the seat support member 242 selectively positioned in the retracted position may be introduced within the remaining portion of the interior cavity 269 of the envelope of the table top 220. Similar to the disposition of the first seating member 214 within the interior cavity 269 of the table top 220, the second seating member 214 rests within a portion of the interior cavity 269 adjacent an opposing side of the frame 216 of the table 212 and abuts part of the pedestals 222, thereby providing a means for retaining the pedestals 222 within the interior cavity 269 of the table top 220 when the table 212 is positioned in the collapsed position for storage or shipping.

When the seating members 214 are collapsed adjacent to the already collapsed pedestals 222 of the table 212, the interior cavity 269 of the envelope of the table 212 may generally house both the pedestals 222 and the seating members 214 therein. One may think of the envelope of a cross-section of structure that would be taken by an elastic band completely encircling the object in question. Thus, a table top 220 may define a straight line portion of an envelope. The size and shape of the frame 216 may define another portion of the envelope of a table 212. If the pedestals 222 and the seat support members 242 nest completely within a table, then a straight line extending across the frame 216 of the table 212 may define another edge of the envelope of the table 212.

With the pedestals 222 and the seating members 214 selectively disposed in the retracted position within the interior cavity 269 of the table top 220, the first support legs 244 of the seat support members 242 may be selectively secured in relation to the underside of the table top 220 by the retaining member 284, as described above. When a user wishes to secure the collapsible table and bench apparatus 210 in the collapsed position, the first support legs 244 of each of the seat support members 242 are engaged by the retaining member 284 which pivotally engages a section of the leg 244 of each seating member 214.

As best shown in FIGS. 18 and 19, a relief 270, 271 is preferably formed in each frame 218 of the seating members 214. Structurally, the relief 270, 271 is formed having a length sufficient so as to receive the support legs 244, 253 of the opposing seating member 214 when the seat support members 242 of the seating members 214 are disposed in a collapsed position within the interior cavity 269 of the table top 220 of the table 212. In one presently preferred embodiment, the legs 244, 253 of the seat support member 242 of a first seating member 214 are designed to overlap the legs 244, 253 of the seat support member 242 of a second seating member 214. Thus, securement of the seat support member 242 of the first seating member 214 will serve to at least partially secure the second seating member 214 within the interior cavity 269 of the table top 220 when the table 212 is disposed in the collapsed position.

In certain alternative embodiments of the present invention, a latch, clip, key, detent, and the like may be utilized to secure the seating members 214 within the cavity 269 of the table top 220 independently thereof, if desired. Accordingly, although the illustrated embodiments include frames 216, 218 of the table 212 and the seating member 242, respectively, and the table top 220 includes an interior cavity 269, it will be appreciated that the collapsible bench and table apparatus as contemplated herein may have these features absent. In particular, the table top 220 and bench seat 221 may be essentially flat in configuration and each comprise one or more retention mechanisms to support and selectively engage the pedestals 222 and seating members 214.

In one presently preferred embodiment, the table 212 and the seating members 214 may be formed of plastic with a hollow structure. The hollow structure may be filled with foam where desired, and left evacuated where desired. Double walls, single walls, and the like may be used to form the table top 220 and the seat 221. Cavities and recesses or kiss-offs may be formed within the underside of the table top 220 and the bench seat 221 to add additional structural integrity to the table 212 and the seating member 214, respectively.

From the above discussion, it will be appreciated that the present invention provides a novel collapsible table and bench apparatus 210, in which each of the seating members 214 are separately deployable from the other seating member 214 and from the table 212. The seating members 214 may be nested alone or together in relation to the table top 220 of the table 212.

In operation, the seating members 214 may be separately useable from the table 212 by removal from their nested positions in the cavity 269 of the table top 220 and deployed. Correspondingly, the seating members 214 and the table 212 do not require each other for any structural mechanism for support during deployment and use above a surface.

In one presently preferred embodiment, the collapsible table and bench apparatus 210 in accordance with the invention may be formed to be carried by a single individual when disposed in the collapsed position. Moreover, a single user may deploy the seating members 214 and the table 212 once positioned in an area for use without requiring the aid of another.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A table comprising:

a table top including an upper surface that is spaced apart from a lower surface and enclosing a hollow interior portion that is formed during the manufacturing process;

a first support leg movable between an extended position and a collapsed position relative to the table top, the first support leg extending away from the table top in the extended position to support the table in a use position, the first support leg being disposed generally parallel to the lower surface of the table top and not extending beyond an outer edge of the table top in the collapsed position;

a second support leg movable between an extended position and a collapsed position relative to the table top, the second support leg extending away from the table top in the extended position to support the table in a use position, the second support leg being disposed generally parallel to the lower surface of the table top and not extending beyond an outer edge of the table top in the collapsed position;

an elongated support member located proximate a central portion of the table top, the elongated support member including a length that is at least half a length of the table top;

a first support brace connected to the first support leg and connected to the elongated support member, at least a portion of the first support brace nesting about at least a portion of the elongated support member when the first support leg is in the collapsed position; and a second support brace connected to the second support leg and connected to the elongated support member, at least a portion of the second support brace nesting about at least a portion of the elongated support member when the second support leg is in the collapsed position.

2. The table as in claim 1, further comprising a lip that extends downwardly from the lower surface of the table top, the lip being integrally formed as part of a unitary, one-piece construction with the table top.

3. The table as in claim 2, wherein the lip includes a lower portion that forms a plane, the first support leg and second support leg being generally disposed between the lower surface of the table top and the plane formed by the lower portion of the lip when the first support leg and the second support leg are in the collapsed position.

4. The table as in claim 2, further comprising an envelope that is formed by the lower surface of the table top and the lip, the first support leg and second support leg being sized and configured to be positioned within the envelope when the first and second support legs are in the collapsed position.

5. The table as in claim 2, further comprising an envelope that is formed by the lower surface of the table top and the lip, the elongated support member being disposed within the envelope.

6. The table as in claim 2, further comprising one or more seating members, each of the one or more seating members including one or more support legs that are movable between an extended position and a collapsed position, the one or more seating members being sized and configured to be positioned within an envelope that is formed by the lower surface of the table top and the lip when the support legs are in the collapsed position.

7. The table as in claim 6, further comprising one or more detents in the lip that are sized and configured to selectively receive a portion of the support legs of the one or more seating members in the collapsed position to secure the seating member to the table top.

8. The table as in claim 2, wherein the lip is disposed about the outer edge of the table top to form a periphery.

9. The table as in claim 2, further comprising a first set of detents in the lip that are sized and configured to selectively receive a portion of the first support leg in the collapsed position and a second set of detents in the lip that are sized and configured to selectively receive a portion of the second support leg in the collapsed position.

10. The table as in claim 1, wherein the elongated support member is generally disposed along a longitudinal axis that extends through a center portion of the table top.

11. The table as in claim 1, wherein the table top is constructed from blow molded plastic and the elongated support member is constructed from metal.

12. The table as in claim 1, further comprising a foot connected to an end of the first support leg, at least a portion of the elongated support member being generally disposed between the table top and the foot when the first support leg is in the collapsed position.

13. The table as in claim 1, wherein the first support leg and the second support leg are pivotally attached to the elongated support member.

14. The table as in claim 1, wherein the first support leg and the second support leg are slidably attached to the elongated support member.

15. The table as in claim 1, wherein the first support leg and the second support leg are pivotally attached to the table top.

16. The table as in claim 1, wherein the first support leg and the second support leg are slidably attached to the table top.

17. The table as in claim 1, wherein the first support brace and the second support brace are pivotally attached to the elongated support member.

18. The table as in claim 1, wherein the first support brace and the second support brace are slidably attached to the elongated support member.

19. A table comprising:

a unitary, one-piece table top including an upper surface that is spaced apart from a lower surface and enclosing a hollow interior portion that is formed during the manufacturing process;

a lip generally extending downwardly from the lower surface of the table top, the lip being integrally formed as part of a unitary one-piece construction with the table top, the lip including a hollow interior portion that is formed during the manufacturing process and is integrally formed with the hollow interior portion of the table top;

a first support leg movable between an extended position and a collapsed position relative to the top, the first support leg extending away from the top in the extended position to support the apparatus in a use position, the first support leg being disposed generally parallel to the lower surface of the top and not extending beyond an outer edge of the top in the collapsed position;

a second support leg movable between an extended position and a collapsed position relative to the top, the second support leg extending away from the top in the extended position to support the apparatus in a use position, the second support leg being disposed generally parallel to the lower surface of the top and not extending beyond an outer edge of the top in the collapsed position;

a central support member connected to the table top and including an elongated length that extends at least a majority of a length of the table top;

a first support brace connected to the first support leg and connected to the central support member; and a second support brace connected to the second support leg and connected to the central support member.

20. The table as in claim 19, wherein at least a portion of the first support brace nests about at least a portion of the central support member when the first support leg is in the collapsed position; and wherein at least a portion of the second support brace nests about at least a portion of the central support member when the second support leg is in the collapsed position.

21. The table as in claim 20, wherein the lip includes a lower portion that forms a plane, the first support leg and second support leg being generally disposed between the lower surface of the table top and the plane formed by the lower portion of the lip when the first support leg and the second support leg are in the collapsed position.

22. The table as in claim 20, further comprising an envelope that is formed by the lower surface of the table top and the lip, the first support leg and second support leg being sized and configured to be positioned within the envelope when the first and second support legs are in the collapsed position.

23. The table as in claim 20, further comprising an envelope that is formed by the lower surface of the table top and the lip, the central support member being disposed within the envelope.

24. The table as in claim 20, further comprising one or more seating members, each of the one or more seating members including one or more support legs that are movable between an extended position and a collapsed position, the one or more seating members being sized and configured to be positioned within an envelope that is formed by the lower surface of the table top and the lip when the support legs are in the collapsed position.

25. The table as in claim 24, further comprising one or more detents in the lip that are sized and configured to selectively receive a portion of the support legs of the one or more seating members in the collapsed position to secure the seating member to the table top.

26. The table as in claim 20, wherein the lip is disposed about the outer edge of the table top to form a periphery.

27. The table as in claim 20, further comprising a first set of detents in the lip that are sized and configured to selectively receive a portion of the first support leg in the collapsed position and a second set of detents in the lip that are sized and configured to selectively receive a portion of the second support leg in the collapsed position.

28. The table as in claim 19, wherein the central support member is generally disposed along a longitudinal axis that extends through a center portion of the table top.

29. The table as in claim 19, wherein the table top is constructed from blow molded plastic and the elongated support member is constructed from metal.

30. The table as in claim 19, further comprising a foot connected to an end of the first support leg, at least a portion of the central support member being generally disposed between the table top and the foot when the first support leg is in the collapsed position.

31. The table as in claim 19, wherein the first support leg and the second support leg are pivotally attached to the central support member.

32. The table as in claim 19, wherein the first support leg and the second support leg are slidably attached to the central support member.

33. The table as in claim 19, wherein the first support leg and the second support leg are pivotally attached to the table top.

34. The table as in claim 19, wherein the first support leg and the second support leg are slidably attached to the table top.

35. The table as in claim 19, wherein the first support brace and the second support brace are pivotally attached to the central support member.

36. The table as in claim 19, wherein the first support brace and the second support brace are slidably attached to the central support member.

37. A table comprising:

a table top constructed from plastic and including an upper surface and a lower surface, the upper surface and the lower surface at least partially enclosing a hollow interior portion formed during the manufacturing process;

a first support leg movable between an extended position and a collapsed position relative to the table top;

a second support leg movable between an extended position and a collapsed position relative to the table top;

an elongated center support member constructed from metal and extending at least a majority of a length of the table top;

a first support brace connecting the first support leg to the elongated center support member, at least a portion of the first support brace nesting about at least a portion of the elongated center support member when the first support leg is in the collapsed position;

a second support brace connecting the second support leg to the elongated center support member, at least a portion of the second support brace nesting about at least a portion of the elongated center support member when the second support leg is in the collapsed position; and a lip that extends downwardly from the lower surface of the table top, the lip including an inner portion and a lower portion, the lip including a hollow interior portion that is formed during the manufacturing process.

38. The table as in claim 37, further comprising one or more depressions in the lower surface of the table top that extend generally towards the upper surface of the table top.

39. The table as in claim 37, further comprising an envelope generally defined by the lower surface of the table top and the downwardly extending lip, the first and second support legs being generally positioned within the envelope when the first and second support legs are in the collapsed position.

40. The table as in claim 37, further comprising an envelope generally defined by the lower surface of the table top and the downwardly extending lip; and further comprising one or more benches, each of the one or more benches including support legs that are movable between an extended position and a collapsed position, the one or more benches capable of being positioned within the envelope when the support legs are in the collapsed position.

41. The table as in claim 37, further comprising a plane generally formed by the lower portion of the lip, the first and second support legs being generally positioned between the lower surface of the table top and the plane when the first and second support legs are in the collapsed position.

42. The table as in claim 37, further comprising a plane generally formed by the lower portion of the lip; and further comprising one or more benches, each of the one or more benches including support legs that are movable between an extended position and a collapsed position, the one or more benches capable of being positioned between the lower surface of the table top and the plane when the support legs of the benches are in the collapsed position.

43. The table as in claim 37, further comprising a cavity formed in the table top that is sized and configured to receive one or more benches.

44. The table as in claim 37, wherein the table top is constructed from blow molded plastic.

45. The table as in claim 37, wherein the first support leg includes a foot portion, at least a portion of the elongated center support member being generally disposed between the table top and the foot portion of the first support leg when the first support leg is in the collapsed position.

46. A table comprising:

a blow molded table top including an upper surface that is spaced apart from a lower surface and enclosing a hollow interior portion that is formed during the blow molding process;

an elongated support member extending along the lower surface of the blow molded table top;

a first support leg including an elongated leg portion, the first support leg movable between an extended position and a collapsed position relative to the blow molded table top, at least a portion of the elongated support member being generally positioned between the blow molded table top and the elongated leg portion when the first support leg is in the collapsed position;

a second support leg including an elongated leg portion, the second support leg movable between an extended position and a collapsed position relative to the blow molded table top, at least a portion of the elongated support member being generally positioned between the blow molded table top and the elongated leg portion when the second support leg is in the collapsed position;

a first support brace including a first end connected the first support leg and a second end connected to the elongated support member, at least a portion of the first support brace nesting about at least a portion of the elongated support member when the first support leg is in the collapsed position; and a second support brace including a first end connected to the second support leg and a second end connected to the elongated support member, at least a portion of the second support brace nesting about at least a portion of the elongated support member when the second support leg is in the collapsed position.

47. A table comprising:

a blow molded table top including an upper surface that is spaced apart from a lower surface and enclosing a hollow interior portion that is formed during the blow molding process;

an elongated support member extending along the lower surface of the blow molded table top;

a first support leg including a foot portion, the first support leg movable between an extended position and a collapsed position relative to the blow molded table top, at least a portion of the elongated support member being generally positioned between the blow molded table top and the foot portion when the first support leg is in the collapsed position;

a second support leg including a foot portion, the second support leg movable between an extended position and a collapsed position relative to the blow molded table top, at least a portion of the elongated support member being generally positioned between the blow molded table top and the foot portion when the second support leg is in the collapsed position;

a first support brace including a first end connected the first support leg and a second end connected to the elongated support member, at least a portion of the first support brace nesting about at least a portion of the elongated support member when the first support leg is in the collapsed position; and a second support brace including a first end connected to the second support leg and a second end connected to the elongated support member, at least a portion of the second support brace nesting about at least a portion of the elongated support member when the second support leg is in the collapsed position.

48. A table comprising:

a unitary, one-piece table top including a hollow interior portion that is formed during the manufacturing process;

a lip including a hollow interior portion that is formed during the manufacturing process, the lip being integrally formed with the table top as part of a unitary, one-piece construction;

a rail being generally centrally disposed along a longitudinal axis of the table top and extending at least a majority of a length of the table top;

a first pedestal being movable relative to the table top between an extended position and a collapsed position, the first pedestal including a first leg that is disposed on one side of the rail and a second leg that is disposed on another side of the rail;

a second pedestal being movable relative to the table top between an extended position and a collapsed position, the second pedestal including a first leg that is disposed on one side of the rail and a second leg that is disposed on another side of the rail;

a first brace including a first end connected to the first pedestal and a second end connected to the rail; and a second brace including a first end connected to the second pedestal and a second end connected to the rail.

49. The table as in claim 48, wherein at least a portion of the first support brace nests about at least a portion of the elongated support member when the first support leg is in the collapsed position; and wherein at least a portion of the second support brace nests about at least a portion of the elongated support member when the second support leg is in the collapsed position.

50. The table as in claim 48, further comprising a first foot that is connected to the ends of the first leg and the second leg of the first pedestal, the first foot being positioned generally adjacent to a portion of the rail when the first pedestal is in the collapsed position; and further comprising a second foot that is connected to the ends of the first leg and the second leg of the second pedestal, the second foot being positioned generally adjacent to a portion of the rail when the second pedestal is in the collapsed position.

51. The table as in claim 48, further comprising a first foot that is connected to the ends of the first leg and the second leg of the first pedestal, the first foot being sized and configured to contact a portion of the rail when the first pedestal is in the collapsed position; and further comprising a second foot that is connected to the ends of the first leg and the second leg of the second pedestal, the second foot being sized and configured to contact a portion of the rail when the second pedestal is in the collapsed position.

52. The table as in claim 48, wherein the first pedestal is pivotally connected to the lip and wherein the second pedestal is pivotally connected to the lip.

53. A table comprising:

a table top including a hollow interior portion that is formed during the manufacturing process;

a lip including a hollow interior portion that is formed during the manufacturing process, the lip being integrally formed with the table top as part of a unitary, one-piece construction;

a metal rail connected to a lower portion of the table top, the metal rail extending at least a majority of a length of the table top;

a first pedestal being movable relative to the table top between an extended position and a collapsed position, the first pedestal including a first leg that is pivotally connected to the table top on one side of the rail and a second leg that is pivotally connected to the table top on another side of the rail;

a second pedestal being movable relative to the table top between an extended position and a collapsed position, the second pedestal including a first leg that is pivotally connected to the table top on one side of the rail and a second leg that is pivotally connected to the table top on another side of the rail;

a first foot connected to an end of the first leg and the second leg of the first pedestal, the first foot being positioned proximate the rail when the first pedestal is in the collapsed position;

a second foot connected to an end of the first leg and the second leg of the second pedestal, the second foot being positioned proximate the rail when the second pedestal is in the collapsed position a first brace including a first end connected to the first pedestal and a second end connected to the rail; and a second brace including a first end connected to the second pedestal and a second end connected to the rail.

54. The table as in claim 53, wherein at least a portion of the first support brace nests about at least a portion of the elongated support member when the first support leg is in the collapsed position; and wherein at least a portion of the second support brace nests about at least a portion of the elongated support member when the second support leg is in the collapsed position.

55. A table comprising:

a table top including a hollow interior portion that is formed during the manufacturing process;

a lip including a hollow interior portion that is formed during the manufacturing process, the lip being integrally formed with the table top as part of a unitary, one-piece construction;

a metal rail connected to a lower portion of the table top, the metal rail extending at least a majority of a length of the table top;

a first pedestal being movable relative to the table top between an extended position and a collapsed position, the first pedestal including a first leg that is pivotally connected to the table top on one side of the rail and a second leg that is pivotally connected to the table top on another side of the rail;

a second pedestal being movable relative to the table top between an extended position and a collapsed position, the second pedestal including a first leg that is pivotally connected to the table top on one side of the rail and a second leg that is pivotally connected to the table top on another side of the rail;

a first brace including a first end connected to the first pedestal and a second end connected to the rail, at least a portion of the first brace nesting about at least a portion of the rail when the first support leg is in the collapsed position; and a second brace including a first end connected to the second pedestal and a second end connected to the rail, at least a portion of the second brace nesting about at least a portion of the rail when the second support leg is in the collapsed position.

56. The table as in claim 55, further comprising a first foot connected to an end of the first leg and the second leg of the first pedestal, the first foot being positioned proximate a portion of the rail when the first pedestal is in the collapsed position; and a second foot connected to an end of the first leg and the second leg of the second pedestal, the second foot being positioned proximate a portion of the rail when the second pedestal is in the collapsed position.

57. The table as in claim 55, wherein the lip includes a lower portion that forms a plane, the first pedestal and the second pedestal being generally disposed between a lower portion of the table top and the plane formed by the lower portion of the lip when the first pedestal and the second pedestal are in the collapsed position.

58. The table as in claim 55, further comprising an envelope that is formed by a lower portion of the table top and the lip, the first pedestal and the second pedestal being sized and configured to be positioned within the envelope when the first pedestal and the second pedestal are in the collapsed position.

* * * * *

UNITED STATES PATENT AND TRADEMARK OFFICE

CERTIFICATE OF CORRECTION

PATENT NO. : 6,945,178 B1 
APPLICATION NO. : 10/190275
DATED : September 20, 2005
INVENTOR(S) : Stephen F. Nye and Lynn C. Strong It is certified that error appears in the above-identified patent and that said Letters Patent is hereby corrected as shown below:

Drawings

Replace Figure 10A with the figure depicted herein below, wherein reference numeral "12" has been changed to --122-- and one instance of reference numeral"98" has been changed to --69--.

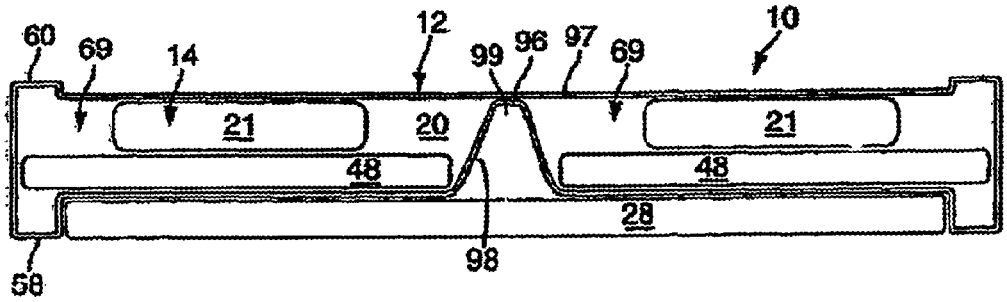

*Fig. 10A*

Replace Figure 10C with the figure depicted herein below, wherein one instance of reference numeral "10" has been changed to --69--.

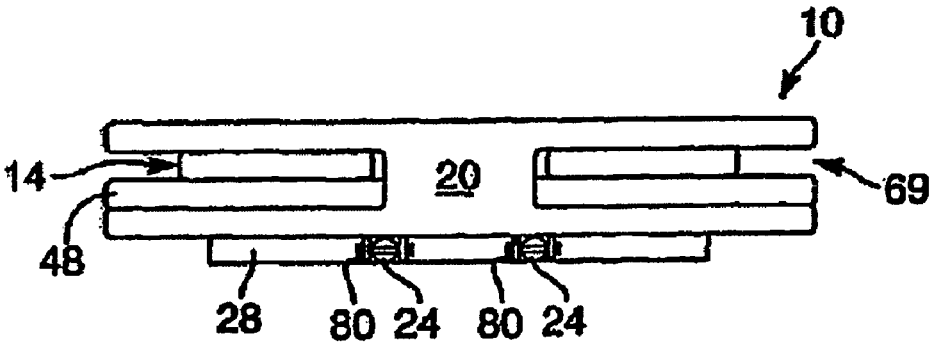

*Fig. 10C*

UNITED STATES PATENT AND TRADEMARK OFFICE

CERTIFICATE OF CORRECTION

PATENT NO. : 6,945,178 B1
APPLICATION NO. : 10/190275
DATED : September 20, 2005
INVENTOR(S) : Stephen F. Nye and Lynn C. Strong It is certified that error appears in the above-identified patent and that said Letters Patent is hereby corrected as shown below:

Column 1
Line 32, remove "C"

Column 3
Line 18, before "minimizing" insert --and--
Line 35, after "in order to" insert --protect--
Line 39, "stiffeners" insert --,--
Line 40, after "polymers" insert --,--

Column 4
Line 32, before "legs" remove "of"
Line 46, change "a an end" to --an end--

Column 6
Line 1, change "table forming," to --table 12, along with the surface 20 may be formed of a resin, by blow-molding, vacuun forming,--

Column 7
Line 46, remove "60"
Line 47, remove both instances of "60"

Column 8
Line 38, change "29" to --49--

Column 11
Line 14, change "FIG. 5C" to --FIG. 8C--
Line 44, change "tops 20" to --tops 21 --.

Column 12
Line 56, change "leg 24" to --leg 24, 44--

Column 13
Line 20, remove "To"
Line 41, change "free to" to --free to be--

Column 14
Line 60, change "table 14" to --table 12--

UNITED STATES PATENT AND TRADEMARK OFFICE

CERTIFICATE OF CORRECTION

PATENT NO. : 6,945,178 B1
APPLICATION NO. : 10/190275
DATED : September 20, 2005
INVENTOR(S) : Stephen F. Nye and Lynn C. Strong It is certified that error appears in the above-identified patent and that said Letters Patent is hereby corrected as shown below:

Column 15
Line 62, change “24” to --224--
Line 65, change “24” to --224--

Column 16
Line 3, change “24” to --224--
Line 6, change “244” to --224--
Line 27, change “244” to --244,253--
Line 30, change “244” to --244,253--
Line 32, change “244” to --244,253--
Line 36, change “244” to --244,253--

Column 22
Line 12, change “242” to --214--

Column 27
Line 44, after “connected” insert --to--

Column 28
Line 11, after “connected” insert --to--

Signed and Sealed this

Fourteenth Day of November, 2006

JON W. DUDAS
*Director of the United States Patent and Trademark Office*